US010913627B2

(12) United States Patent
Nagata et al.

(10) Patent No.: US 10,913,627 B2
(45) Date of Patent: Feb. 9, 2021

(54) FEEDING APPARATUS AND METHOD FOR THE SAME

(71) Applicant: CANON KABUSHIKI KAISHA, Tokyo (JP)

(72) Inventors: Naohisa Nagata, Moriya (JP); Hiroshi Hagiwara, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 283 days.

(21) Appl. No.: 16/012,168

(22) Filed: Jun. 19, 2018

(65) Prior Publication Data

US 2019/0002224 A1 Jan. 3, 2019

(30) Foreign Application Priority Data

Jun. 30, 2017 (JP) ..... 2017-128952

(51) Int. Cl.
*B65H 7/02* (2006.01)
*B65H 3/06* (2006.01)

(52) U.S. Cl.
CPC ..... *B65H 7/02* (2013.01); *B65H 3/06* (2013.01); *B65H 3/0661* (2013.01); *B65H 2511/10* (2013.01); *B65H 2511/20* (2013.01); *B65H 2513/50* (2013.01); *B65H 2515/40* (2013.01); *B65H 2515/805* (2013.01); *B65H 2515/83* (2013.01)

(58) Field of Classification Search
CPC ..... B65H 7/02
See application file for complete search history.

(56) References Cited

U.S. PATENT DOCUMENTS 7,584,956 B2 * 9/2009 Yamagishi ..... B65H 1/04 271/171
7,731,183 B2 * 6/2010 Ohno ..... B65H 1/266 271/171
8,047,542 B2 * 11/2011 Hara ..... B65H 5/06 271/265.01
9,027,925 B2 * 5/2015 Alaas ..... B65H 7/12 271/258.01
9,944,480 B2 * 4/2018 Hirano ..... B65H 3/52
(Continued)

FOREIGN PATENT DOCUMENTS

JP 8-169575 A 7/1996
JP 2001142373 A 5/2001
(Continued)

*Primary Examiner* — Michael McCullough
(74) *Attorney, Agent, or Firm* — Canon U.S.A., Inc. I.P. Division

(57) ABSTRACT

A feeding apparatus includes a placement unit on which a recording material is to be placed, a feeding rotating member, a regulating plate, a detecting unit, and a control unit. The feeding rotating member feeds the recording material placed on the placement unit. The regulating plate regulates a position of an upstream end of the recording material placed on the placement unit in a direction of feeding by the feeding rotating member. The detecting unit detects a size of the recording material from a position of the regulating plate. The control unit changes duration of execution of a recording-material feeding operation performed by the feeding rotating member based on the size of the recording material detected by the detecting unit and a size of the recording material specified in advance by a user.

25 Claims, 19 Drawing Sheets

(56) References Cited

U.S. PATENT DOCUMENTS

| | | | | |
|---|---|---|---|---|
| 10,191,433 | B2 * | 1/2019 | Watanabe | G03G 15/6564 |
| 10,518,995 | B2 * | 12/2019 | Nakayoshi | H04N 1/0071 |
| 10,759,619 | B2 * | 9/2020 | Sugiura | G03G 15/6594 |
| 2005/0196211 | A1 * | 9/2005 | Miki | B65H 1/266 399/389 |
| 2009/0066011 | A1 * | 3/2009 | Ohno | B65H 1/266 271/171 |

FOREIGN PATENT DOCUMENTS

| | | | |
|---|---|---|---|
| JP | 201444263 | A | 3/2014 |
| JP | 2015139931 | A | 8/2015 |
| JP | 201752572 | A | 3/2017 |

* cited by examiner

| RANGE | REGULATING-PLATE DETECTING MECHANISM 57 | | MINIMUM SHEET LENGTH [mm] | MAXIMUM SHEET LENGTH [mm] |
|---|---|---|---|---|
| | SW70 | SW71 | | |
| 1101 | OFF | ON | 148.0 | 277.9 |
| 1102 | OFF | OFF | 278.0 | 289.9 |
| 1103 | ON | OFF | 290.0 | 305.9 |
| 1104 | ON | ON | 306.0 | 457.0 |

FIG. 12A

| REGULATING-PLATE DETECTING MECHANISM 57 | | CLUTCH ON DISTANCE [mm] |
|---|---|---|
| SW70 | SW71 | |
| OFF | ON | 148.0 |
| OFF | OFF | 278.0 |
| ON | OFF | 290.0 |
| ON | ON | 306.0 |

FIG. 12B

| REGULATING-PLATE DETECTING MECHANISM 57 | | SPECIFIED SHEET LENGTH [mm] | | | |
|---|---|---|---|---|---|
| SW70 | SW71 | 148.0 TO 277.9 | 278.0 TO 289.9 | 290.0 TO 305.9 | 306.0 TO 457.0 |
| OFF | ON | SPECIFIED LENGTH | 148.0 | 148.0 | 148.0 |
| OFF | OFF | SPECIFIED LENGTH | SPECIFIED LENGTH | 278.0 | 278.0 |
| ON | OFF | SPECIFIED LENGTH | SPECIFIED LENGTH | SPECIFIED LENGTH | 290.0 |
| ON | ON | SPECIFIED LENGTH | SPECIFIED LENGTH | SPECIFIED LENGTH | SPECIFIED LENGTH |

FIG. 18

| | | ABSOLUTE MOISTURE CONTENT [g/m³] | | |
|---|---|---|---|---|
| | | 0 TO 5.8 | 5.9 TO 18.0 | 18.1 OR MORE |
| SHEET TYPE | THIN PAPER | FIG. 12A | FIG. 12A | FIG. 12A |
| | PLAIN PAPER | FIG. 12B | FIG. 12A | FIG. 12A |
| | CARDBOARD | FIG. 12B | FIG. 12B | FIG. 12B |

FEEDING APPARATUS AND METHOD FOR THE SAME

BACKGROUND OF THE INVENTION

Field of the Invention

The present disclosure relates to a feeding apparatus in an image forming apparatus, such as a copier or a printer, and a method for the feeding apparatus.

Description of the Related Art

In image forming apparatuses, such as copiers and printers, users can specify a sheet size different from the size of sheets in a sheet feed port, such as a cassette.

Japanese Patent Laid-Open No. 2015-139931 discloses an image forming apparatus having a configuration in which its cassette has regulating plates that regulate the position of sheets accommodated therein and the size of the sheets is detected from the position of the regulating plates. The image forming apparatus disclosed in Japanese Patent Laid-Open No. 2015-139931 is controlled not to perform an image forming operation when the sheet size detected from the position of the regulating plates is not included in a sheet size group specified by the user.

However, with the control disclosed in Japanese Patent Laid-Open No. 2015-139931, there is a possibility that the image forming operation is not started when the position of the regulating plate is deviated from the sheets in the cassette even if the size of sheets contained in the cassette and the sheet size specified by the user are the same. Because of such a possibility, there is a need for executing the image forming operation even if the sheet size specified by the user and the sheet size detected from the position of the regulating plate differ. In the case where the specified sheet size is indefinite, such as a universal mode, the control disclosed in Japanese Patent Laid-Open No. 2015-139931 is not applicable at all.

To deal with a wide variety of types of sheet, a configuration for feeding sheets with high stiffness, such as cardboard, without delay has been required in recent years. As image forming apparatuses have become compact, the curvature of the conveying path has increased, and the shape has become complicated. For those reasons, the load applied to a sheet feeding roller for feeding sheets from the cassette has become larger than before. This leads to a tendency to assist the conveyance of sheets by rotating the sheet feeding roller until just before the trailing end of the sheet passes through the sheet feeding roller.

In this configuration, if the size of sheets contained in the cassette is smaller than a sheet size specified by the user, there is a possibility that after the first sheet is fed from the cassette, the second sheet is also fed to the middle because the rotation time of the sheet feeding roller is long. This can cause a sheet jam, thus decreasing the usability. In contrast, in the case where the size of sheets contained in the cassette is larger than a sheet size specified by the user, the rotation time of the sheet feeding roller is short. This results in a shortage of sheet assist force, causing the conveyance of sheets to stop halfway. This can also cause a sheet jam, thus decreasing the usability.

SUMMARY OF THE INVENTION

The present disclosure provides a feeding apparatus in which a sheet jam due to a difference between a specified sheet size and the size of sheets placed on a placement unit is reduced to increase the usability, as well as a method for the feeding apparatus.

According to an aspect of the present disclosure, a feeding apparatus includes a placement unit on which a recording material is to be placed, a feeding rotating member configured to feed the recording material placed on the placement unit, a regulating plate configured to regulate a position of an upstream end of the recording material placed on the placement unit in a direction of feeding by the feeding rotating member, a detecting unit configured to detect a size of the recording material from a position of the regulating plate, and a control unit configured to change duration of execution of a recording-material feeding operation performed by the feeding rotating member based on the size of the recording material detected by the detecting unit and a size of the recording material specified in advance by a user.

Further features of the present invention will become apparent from the following description of embodiments with reference to the attached drawings.

BRIEF DESCRIPTION OF THE DRAWINGS

FIG. 12A is a table for determining the driving distance of a sheet feeding clutch.

FIG. 12B is a table for determining the driving distance of the sheet feeding clutch.

FIG. 18 is a table for selecting a sheet-feeding-clutch driving distance table.

DESCRIPTION OF THE EMBODIMENTS

First Embodiment

Outline of Image Forming Apparatus

Figure 1:
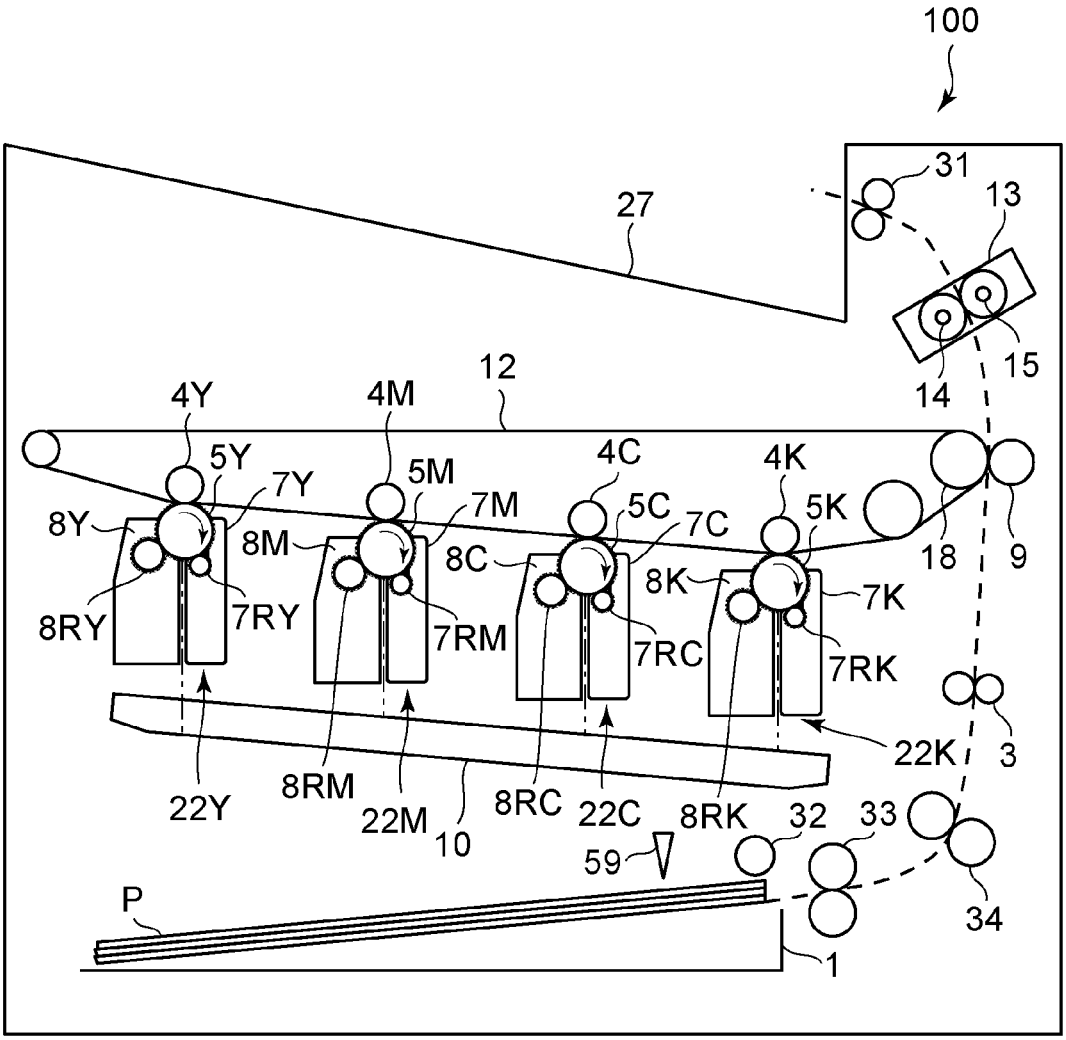
FIG. 1 is a schematic diagram of an image forming apparatus according to a first embodiment of the present disclosure.

The outline of an image forming apparatus according to a first embodiment will be described with reference to FIG. 1. In the present embodiment, an electrophotographic color laser printer will be described as the image forming apparatus.

A laser beam printer 100 (hereinafter depicted as "printer 100") illustrated in FIG. 1 forms a color image on a sheet of paper P (a recording material). The image forming operation of the printer 100 will be described. First, the printer 100 exposes a plurality of image bearing members based on pixel signals transmitted from a control unit 201 (see FIG. 2) to form electrostatic latent images. The printer 100 develops the electrostatic latent images with toner to form toner images on the individual plurality of image bearing members. The color toner images are superposed on an intermediate transfer member, and a color toner image is formed on the intermediate transfer member. The printer 100 transfers the color toner image to the sheet P and fixes the color toner image on the sheet P to the sheet P to thereby perform image formation.

The printer 100 includes a photosensitive drum 5 serving as an image bearing member, a charging unit 7, a developing unit 8, and a primary transfer roller 4 for each of yellow (Y), magenta (M), cyan (C), and black (K) stations. In FIG. 1, a member of a specific color is represented by attaching one of signs indicating the colors (Y, M, C, and K) to a sign corresponding to the member. For example, a yellow photosensitive drum is denoted by 5Y. In the case where there is no need to specify a member of a specific color, the signs representing the colors (Y, M, C, and K) will be omitted below. The printer 100 further includes an intermediate transfer belt 12, which is the intermediate transfer member. The photosensitive drum 5, the charging unit 7, and the developing unit 8 are united as a cartridge 22 and can be detachable from the main body (also referred to as "casing") of the printer 100.

The photosensitive drums 5 each have a configuration in which an organic photoconductor layer is applied on the outer periphery of an aluminum cylinder. The photosensitive drums 5 are rotated when a driving force from a drum motor (see FIG. 2) is transmitted thereto. The drum motor rotates the photosensitive drums 5 clockwise according to the image forming operation. The charging units 7 each include a charging roller 7R for charging the photosensitive drums 5. The photosensitive drums 5 charged by the charging roller 7R are exposed by a scanner unit 10. The scanner unit 10 selectively exposes the surface of the photosensitive drums 5 to form an electrostatic latent image on the photosensitive drums 5. The developing units 8 each include a developing roller 8R for visualizing the electrostatic latent image formed on the photosensitive drums 5 with toner.

During image formation, the intermediate transfer belt 12 is rotating counterclockwise in a state in which it is in contact with the photosensitive drums 5. The toner images formed on the photosensitive drums 5 by the developing rollers 8R are superposed on the intermediate transfer belt 12 by a primary transfer bias applied by the primary transfer rollers 4. The color toner image transferred to the intermediate transfer belt 12 is then transferred to the sheet P at a transfer nip formed between a secondary transfer roller 9 and a facing roller 18 by a secondary transfer bias applied to the secondary transfer roller 9. The primary transfer rollers 4 and the secondary transfer roller 9 rotate with the rotation of the intermediate transfer belt 12.

A sheet feed cassette 1 (placement unit) is one of sheet feed ports in which sheets P can be held (placed), which can hold a variety of sizes of sheets. The sheets P held in the sheet feed cassette 1 are each fed by a pickup roller 32 and a sheet feeding roller 33 (collectively referred to as "feeding rotating member") into a drawing roller pair 34. Thereafter, the sheet P is conveyed by a registration roller pair 3. The registration roller pair 3 conveys the sheet P to the transfer nip at the same timing as the color toner image formed on the intermediate transfer belt 12. The details of the operation for feeding the sheet P from the sheet feed cassette 1 will be described later. A sheet detection sensor 59 is a sensor for detecting whether sheets P are held in the sheet feed cassette 1.

A fixing unit 13 is used to fix the transferred color toner image to the sheet P while conveying the sheet P and includes a fixing roller 14 for heating the sheet P and a pressing roller 15 for pressing the sheet P into contact with the fixing roller 14. The fixing roller 14 and the pressing roller 15 each have a hollow. The fixing roller 14 includes a heater and a sensor for measuring the temperature. The heater is controlled to a temperature suitable for fixing the toner image. The sheet P that bears the color toner image is conveyed by the fixing roller 14 and the pressing roller 15, during which the toner is fixed to the surface of the sheet P by application of heat and pressure. The sheet P to which the toner image is fixed is discharged to an output tray 27 by a discharge roller 31, and the image forming operation ends.

System Configuration of Image Forming Apparatus

Figure 2:
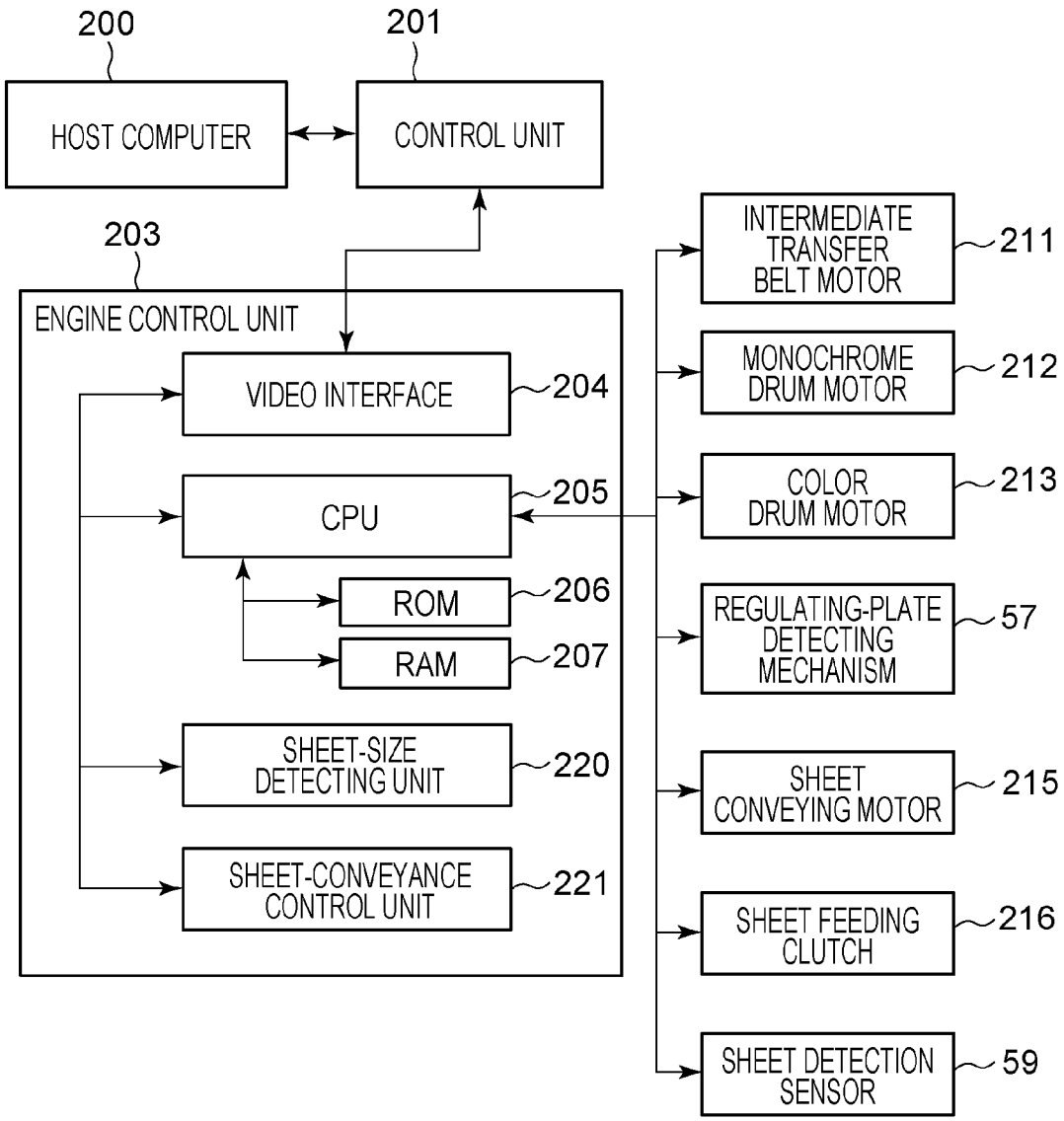
FIG. 2 is a block diagram illustrating the system configuration of the image forming apparatus according to the first embodiment.

Next, the general system configuration of the control unit of the printer 100 will be described with reference to a block diagram in FIG. 2. In FIG. 2, reference sign 200 denotes a host computer, 201 denotes a control unit, and 203 denotes an engine control unit. The engine control unit 203 includes a video interface 204, a central processing unit (CPU) 205, a sheet-size detecting unit 220, and a sheet-conveyance control unit 221.

The control unit 201 receives image information and a printing instruction from the host computer 200 and analyzes the received image information to convert the image information to bit data. The control unit 201 transmits a printing reservation command, a printing start command, and a video signal to the engine control unit 203 via the video interface 204. The CPU 205 of the engine control unit 203 operates various actuators based on information obtained from various sensors to complete the image forming operation. Examples of the various sensors include a regulating-plate detecting mechanism 57 and the sheet detection sensor 59. Examples of the various actuators include an intermediate transfer belt motor 211, a monochrome drum motor 212, a color drum motor 213, a sheet conveying motor 215, and a sheet feeding clutch 216. The CPU 205 includes a ROM 206 that stores program codes and data and a RAM 207 for use in temporary data storage.

The intermediate transfer belt motor 211 drives the facing roller 18 to rotate the intermediate transfer belt 12. The monochrome drum motor 212 drives the photosensitive drum 5K to rotate it. The color drum motor 213 drives the individual photosensitive drums 5Y, 5M, and 5C to rotate them.

The regulating-plate detecting mechanism 57 outputs positional information on a trailing-end regulating plate 42 (see FIG. 5 and FIG. 6A) provided in the sheet feed cassette 1 to the CPU 205. The sheet detection sensor 59 detects whether sheets P are held in the sheet feed cassette 1 and outputs sheet detection information to the CPU 205. The sheet-size detecting unit 220 detects the position of the trailing end of the sheets P held in the sheet feed cassette 1 from the sensor value output from the regulating-plate detecting mechanism 57. The sheet-conveyance control unit 221 determines whether sheets P are contained in the sheet feed cassette 1 from the output of the sheet detection sensor 59 and controls the sheet conveying motor 215 and the sheet feeding clutch 216 to convey the sheets P contained in the sheet feed cassette 1.

Feeding Operation from Sheet Feed Cassette

Next, the operation of conveying the sheets P from the sheet feed cassette 1 performed by the sheet-conveyance control unit 221 will be described with reference to FIGS. 3 and 4.

Figure 3:
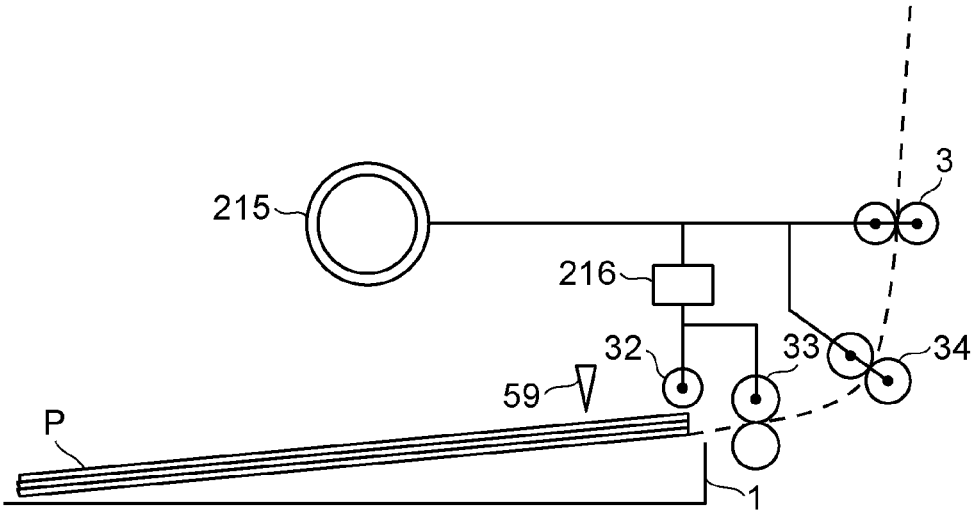
FIG. 3 is a schematic diagram illustrating a sheet feeding mechanism.

FIG. 3 is a schematic diagram illustrating the sheet feeding mechanism in the vicinity of the sheet feed cassette 1. The registration roller pair 3 and the drawing roller pair 34 rotate when a driving force is directly supplied from the sheet conveying motor 215. The pickup roller 32 and the sheet feeding roller 33 are supplied with a driving force from the sheet conveying motor 215 via the sheet feeding clutch 216.

Figure 4:
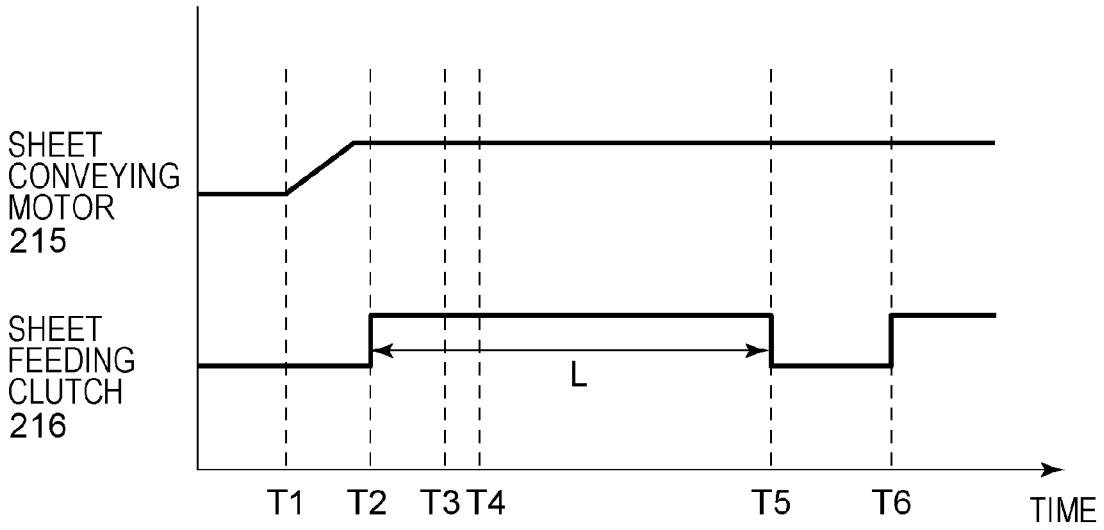
FIG. 4 is a timing chart for sheet conveyance control.

FIG. 4 is a timing chart for feeding the sheets P from the sheet feed cassette 1. The sheet-conveyance control unit 221 starts to drive the sheet conveying motor 215 at timing T1 when a print job is started. Next, at timing T2 when the rotation of the sheet conveying motor 215 becomes stable and the feeding of the sheets P is started, the sheet feeding clutch 216 is driven to start pickup and feeding of the sheets P with the pickup roller 32 and the sheet feeding roller 33. At timing T3, the leading end (the downstream end in the conveying direction) of each sheet P fed from the sheet feed cassette 1 is nipped by the drawing roller pair 34, and at timing T4, the leading end is nipped by the registration roller pair 3 for conveyance. At timing T5 after the sheet P is conveyed a predetermined distance, the sheet feeding clutch 216 is stopped. Next, at timing T6, the sheet feeding clutch 216 is driven again to feed the next sheet P, and the same operation is repeated.

In the present embodiment, the distance corresponding to the interval from timing T1 at which feeding of the sheet P is started to timing T3 at which the leading end of the sheet P reaches the drawing roller pair 34 is 60 millimeters (mm). The distance corresponding to the interval from timing T3 at which the leading end of the sheet P reaches the drawing roller pair 34 to timing T4 at which the leading end of the sheet P reaches the registration roller pair 3 is 20 mm. The length of minimum sheets that the printer 100 can print is 148 mm, which is set based on the longest distance of the distances between the rollers.

Configuration of Sheet Feed Cassette

Figure 5:
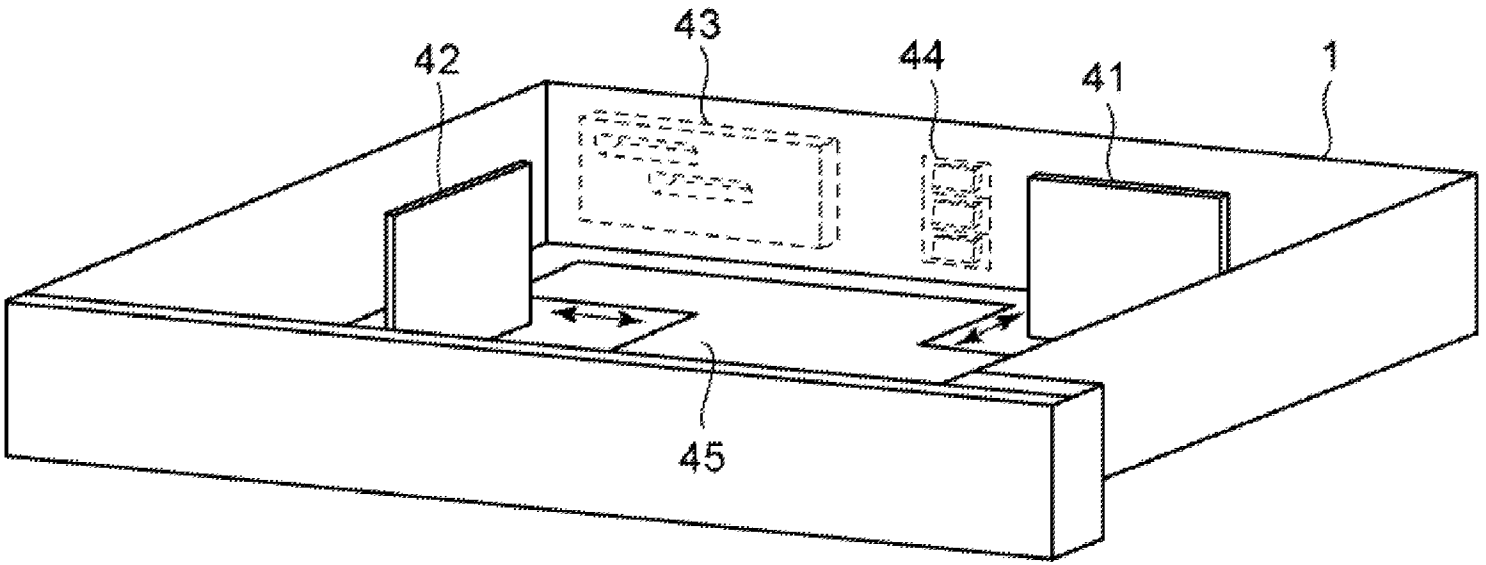
FIG. 5 is a perspective view of a sheet feed cassette.
Figure 6A:
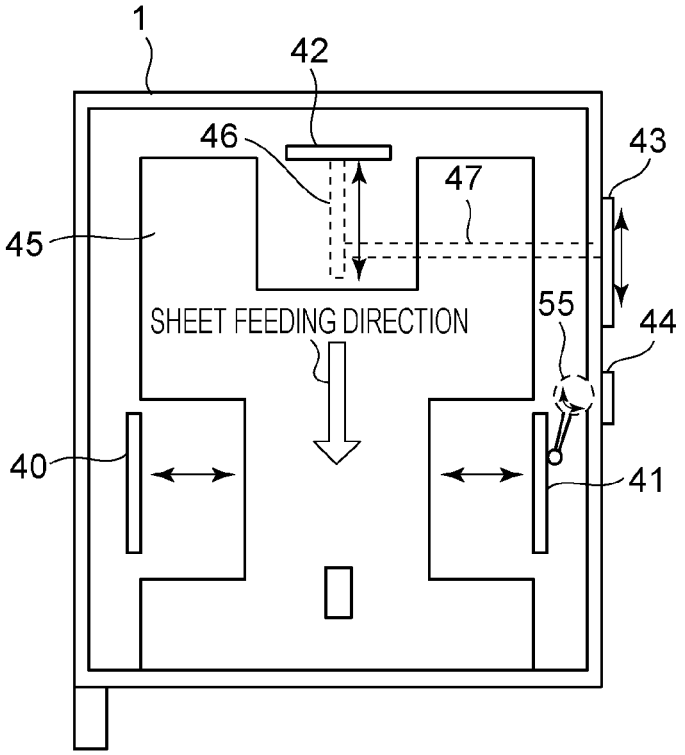
FIG. 6A is a plan view of the sheet feed cassette.
Figure 6B:
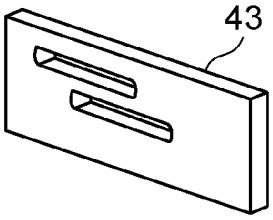
FIG. 6B is a perspective view of a transmission member.
Figure 6C:
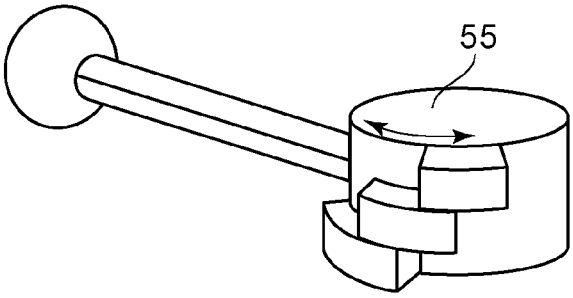
FIG. 6C is a perspective view of a cassette contact piece.

Next, the configuration of the sheet feed cassette 1 will be described with reference to FIG. 5 and FIGS. 6A to 6C. FIG. 5 is a perspective view of the sheet feed cassette 1. FIG. 6A is a plan view of the sheet feed cassette 1. FIG. 6B is a perspective view of a transmission member 43. FIG. 6C is a perspective view of a cassette contact piece 55.

Side-edge regulating plates 40 and 41 are used to regulate the position of the sheets P in the widthwise direction of the sheets P (in a direction perpendicular to the feeding direction). The trailing-end regulating plate 42 is used to regulate the position of the sheets P in the longitudinal direction of the sheets P (in the feeding direction). The side-edge regulating plates 40 and 41 are operatively movable along the width of the sheets P. The trailing-end regulating plate 42 is movable along the length of the sheets P. When setting the sheets P in the sheet feed cassette 1, the user moves the positions of the side-edge regulating plates 40 and 41 and the trailing-end regulating plate 42 so that the side-edge regulating plates 40 and 41 and the trailing-end regulating plate 42 fit the ends of the sheets P. This allows the contained sheets P to be evened up, allowing the sheets P to be fed from the sheet feed cassette 1 without skew and delay.

A transmission member 43 is used to transmit the position of the trailing-end regulating plate 42. When the user changes the position of the trailing-end regulating plate 42, the position of the transmission member 43 changes via link mechanisms 46 and 47. As illustrated in FIG. 6B, the transmission member 43 has holes in upper and lower stages, between which the transmission member 43 switches depending on the position of the trailing-end regulating plate 42.

A transmission member 44 is used to transmit the positions of the side-edge regulating plates 40 and 41. When the user changes the position of the side-edge regulating plate 41, the cassette contact piece 55 rotates. As illustrated in FIG. 6C, a portion of the cassette contact piece 55 pushing the transmission member 44 changes as it rotates, so that any of the upper, middle, and lower protrusions of the transmission member 44 physically protrudes. An intermediate plate 45 is used to elevate the sheets P to a position where the sheets P can be fed by the pickup roller 32.

Relationship Between Sheet Feed Cassette and Image Forming Apparatus

Figure 7:
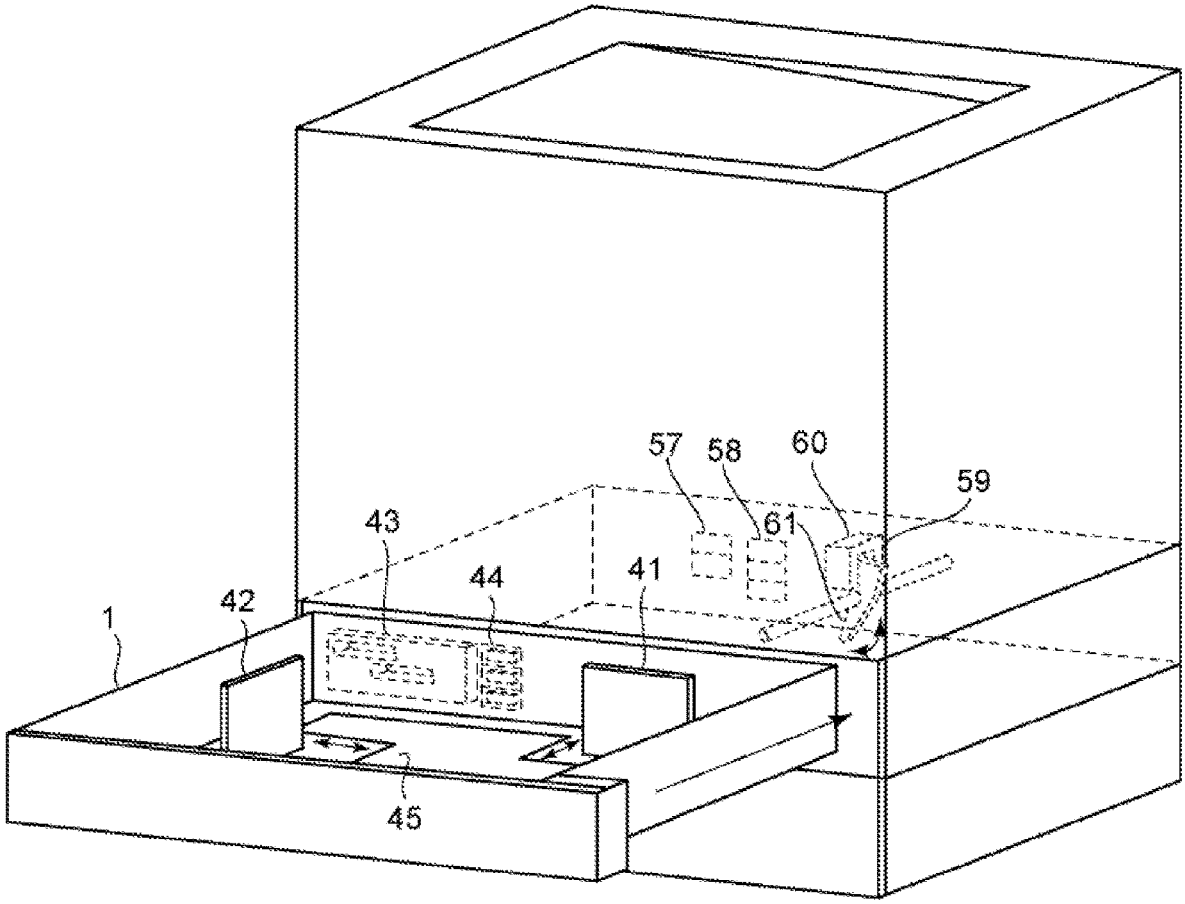
FIG. 7 is a perspective view of the sheet feed cassette and the main body of the image forming apparatus.

FIG. 7 is a perspective view of the sheet feed cassette 1 and the main body of the printer 100 illustrating the configuration thereof. A regulating-plate detecting mechanism 57 is used to detect the recesses and protrusions of the transmission member 43. A regulating-plate detecting mechanism 58 is used to detect the recesses and protrusions of the transmission member 44.

When the sheet feed cassette 1 is mounted to the main body of the printer 100 by the user, the regulating-plate detecting mechanisms 57 and 58 respectively detect the recesses and protrusions of the transmission member 43 and the transmission member 44 to detect the positions of the side-edge regulating plates 40 and 41 and the trailing-end regulating plate 42. The sheet detection sensor 59 is used to detect the sheets P contained in the sheet feed cassette 1 and includes a photo interrupter 60 and a sensor flag 61.

Figure 8A:
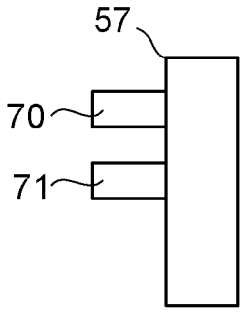
FIG. 8A is a cross-sectional view of a regulating-plate detecting mechanism.
Figure 8B:
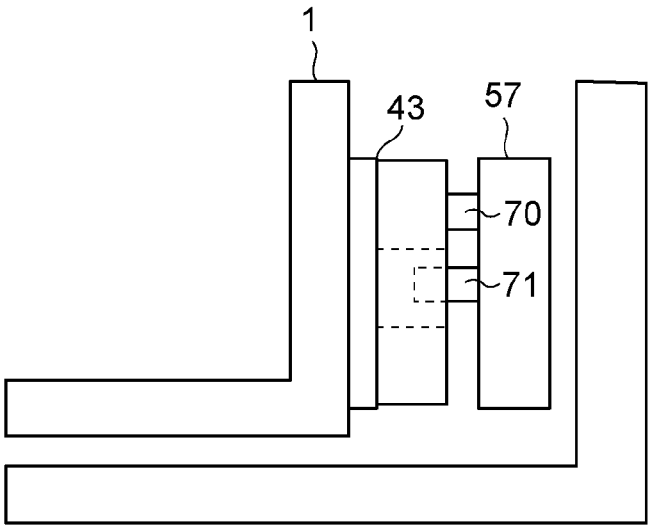
FIG. 8B is a cross-sectional view of the regulating-plate detecting mechanism and the sheet feed cassette illustrating the relationship between them.

FIGS. 8A and 8B are cross-sectional views of the regulating-plate detecting mechanism 57 and the sheet feed cassette 1 illustrating the relationship between them. The regulating-plate detecting mechanism 57 includes a switch 70 and a switch 71. When the sheet feed cassette 1 is mounted, the protrusions of the transmission member 43 pushes the switch 70 or/and 71. The regulating-plate detecting mechanism 58 also has the same configuration. FIG. 8B illustrates a state in which the protrusion of the transmission member 43 pushes only the switch 70.

The relationship between values detected by the regulating-plate detecting mechanism 57 and the position of the trailing-end regulating plate 42 of the sheet feed cassette 1 will be described with reference to FIGS. 9A and 9B. The moving position of the trailing-end regulating plate 42 is restricted by a stopper (not illustrated). The trailing-end regulating plate 42 can be moved between position A and position B in FIG. 9A. The moving range therebetween is sectioned into four ranges 1101, 1102, 1103, and 1104. The individual ranges and the output values of the regulating-plate detecting mechanism 57 have the relation in FIG. 9B.

For example, in the range 1101, the output values of the regulating-plate detecting mechanism 57 are switch 70: OFF and switch 71: ON, and the minimum size and the maximum size of the sheet P corresponding to the range 1101 are respectively 148.0 mm and 277.9 mm. In the range 1102, the output values of the regulating-plate detecting mechanism 57 are switch 70: OFF and switch 71: OFF, and the minimum size and the maximum size of the sheet P corresponding to the range 1102 are respectively 278.0 mm and 289.9 mm. In the range 1103, the output values of the regulating-plate detecting mechanism 57 are switch 70: ON and switch 71: OFF, and the minimum size and the maximum size of the sheet P corresponding to the range 1103 are respectively 290.0 mm and 305.9 mm. In range 1104, the output values of the regulating-plate detecting mechanism 57 are switch 70: ON and switch 71: ON, and the minimum size and the maximum size of the sheet P corresponding to the range 1104 are respectively 306.0 mm and 457.0 mm.

The sheet-size detecting unit 220 determines which of the ranges 1101 to 1104 the trailing-end regulating plate 42 is located in from the output signals from the switches 70 and 71 to determine the size range of the sheets P. The details of a method for setting the size ranges (the minimum size and the maximum size) of the sheets P, listed in FIG. 9B, will be described later.

Specifying Size of Recording Material at Printing

Printing of a document that the user created on the host computer 200 is started via a printer driver, and a printing instruction set by the printer driver and image information on the document are transmitted to the control unit 201.

Figure 10A:
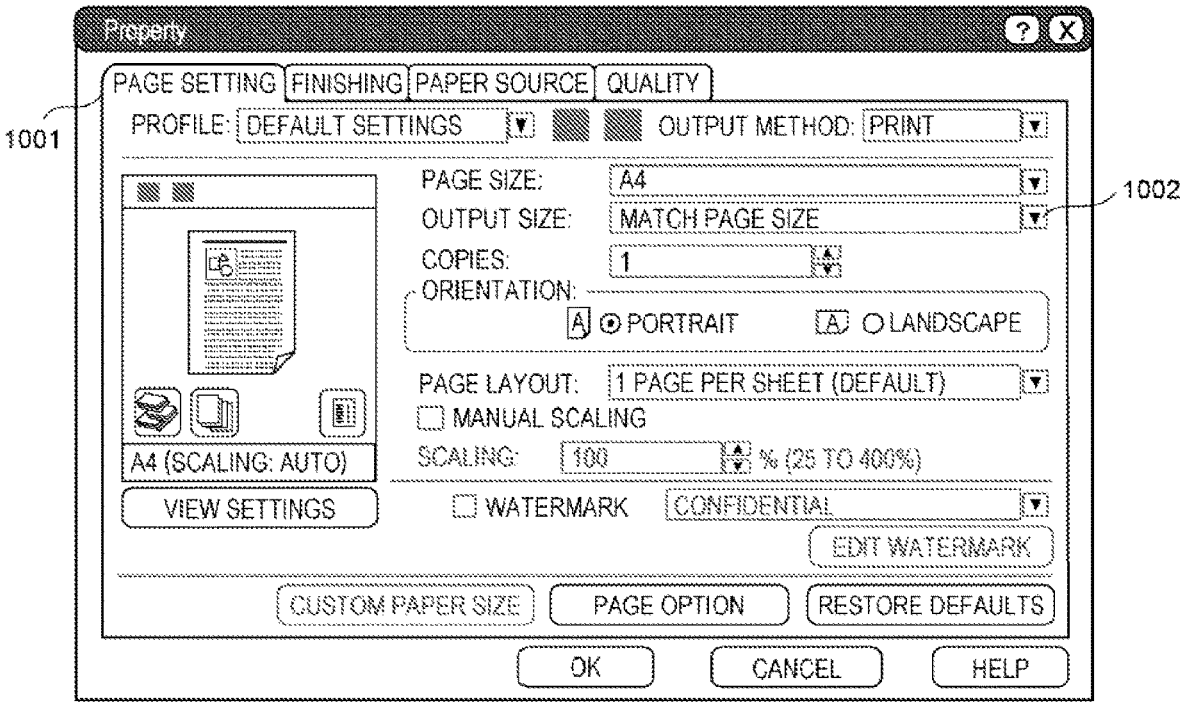
FIGS. 10A to 10C illustrate a property setting screen of a printer driver according to the first embodiment.
Figure 10B:
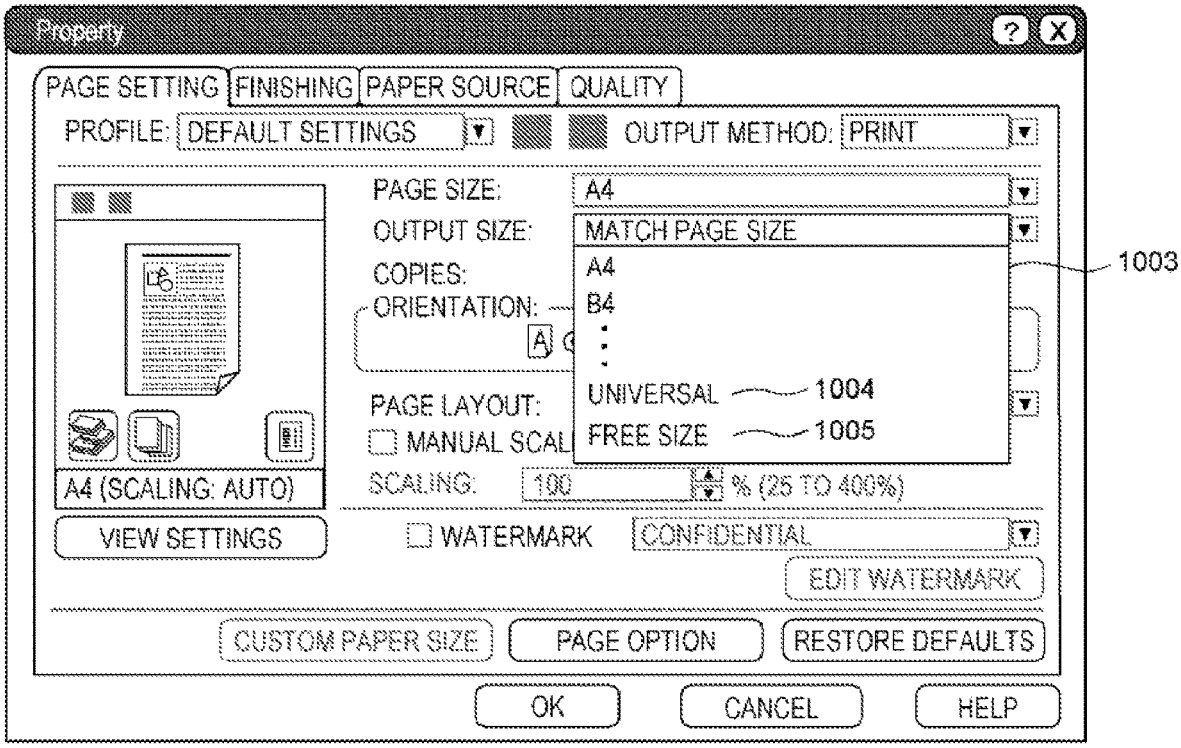
Figure 10C:
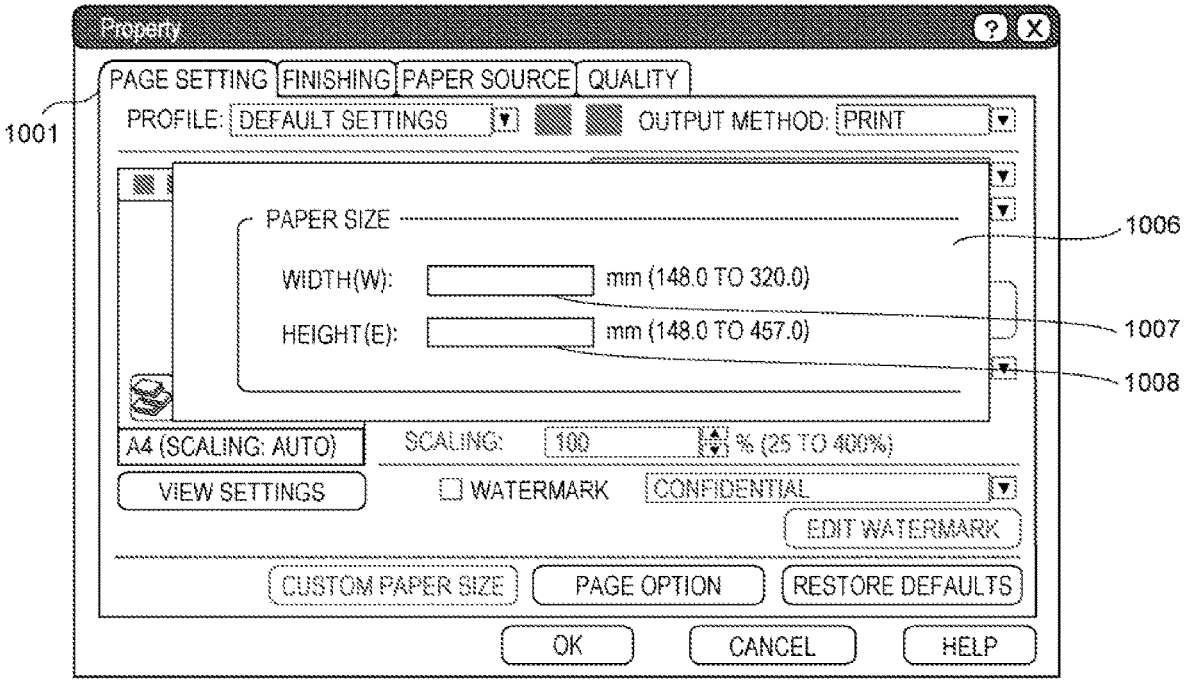

Referring to FIGS. 10A to 10C, the specification of the size of the sheets P at the time of printing will be described. FIG. 10A is a property setting screen of the printer driver, in which a page size, an output sheet size, the number of copies, and so on can be set on a page setting screen 1001. When a pull-down 1002 for output sheet size is selected, a size option menu 1003 in FIG. 10B is displayed. In the size option menu 1003, Universal 1004 and Free size 1005 are displayed as well as A4 and B4, which are standard sizes. Universal 1004 is a specification for the user to perform printing regardless of the size of the sheets P contained in the sheet feed cassette 1. Free size 1005 is, for example, a specification for the user to use sheets P cut in a predetermined size. When the user selects Free size 1005, a size setting screen 1006 in FIG. 10C is displayed. The user inputs the width and height of the sheets P to be used into a width entry field 1007 and a height entry field 1008, respectively.

The thus-specified sheet size is notified as a printing instruction to the control unit 201. The control unit 201 notifies the engine control unit 203 of the sheet width information set by the driver as width information on the sheets P to be fed in the printer and the sheet height information as length information on the sheets P. In the case where Universal 1004 is specified, a code indicating "indefinite" is transmitted together with the width information and the length information to the engine control unit 203. In the case where Free size 1005 is specified, the width entered in the width entry field 1007 as width information and the height entered as length information in the height entry field 1008 are transmitted. In the case where a standard size is selected, a width and a length corresponding to the standard size are transmitted. The CPU 205 stores the width information and the length information received via the video interface 204 in the RAM 207.

Issues of Conventional Feeding Control

Referring to FIG. 3, issues of conventional feeding control will be described. In the conventional feeding control, after feeding of the sheets P is started by driving the sheet conveying motor 215 to drive the sheet feeding clutch 216, the sheet feeding clutch 216 is stopped at the timing at which the leading end of the sheet P is nipped by the registration roller pair 3. This causes the driving force from the sheet conveying motor 215 to the pickup roller 32 and the sheet feeding roller 33 is interrupted, but the sheet P is being conveyed by the drawing roller pair 34 and the registration roller pair 3. As the sheet P is conveyed, the pickup roller 32 and the sheet feeding roller 33 are rotated therewith. In the conventional feeding control, the sheet feeding clutch 216 is driven while sheets P having a length from 148 mm to 457 mm that can be printed by the printer 100 is conveyed the distance 80 mm from the position of the pickup roller 32 to the registration roller pair 3.

However, the curvatures of bent portions of the conveying path tend to increase to reduce the size of the apparatus. This requires assisting the conveyance at the upstream side with the pickup roller 32 and the sheet feeding roller 33 also after the leading end of the sheet P is nipped by the registration roller pair 3. For that reason, the sheet feeding clutch 216 is continuously driven as long as possible while sheets P are fed.

In Universal 1004, which is provided for the convenience of the user, sheets P of any length may be placed in the sheet feed cassette 1, and a code indicating "indefinite" is transmitted as sheet size information to the engine control unit 203. Therefore, the CPU 205 operates assuming that sheets P of a maximum length that can be printed by the printer 100 are placed.

Suppose that the sheet feeding clutch 216 is driven until the sheet P is conveyed 457 mm corresponding to the maximum length in order to assist in conveying the sheet P. In this case, when sheets P of a length of, for example, 420 mm, are contained in the sheet feed cassette 1, the next sheet P is conveyed 37 mm in the feeding operation for one page, causing a sheet jam. In the case of Free size 1005, the user sets the length of the sheet P, so that the length information that the CPU 205 receives and the length of the sheets P contained in the sheet feed cassette 1 can differ due to a setting error or the like, causing the issue that the sheets P cannot be fed correctly.

Sheet Feeding Operation of First Embodiment

Figure 11:
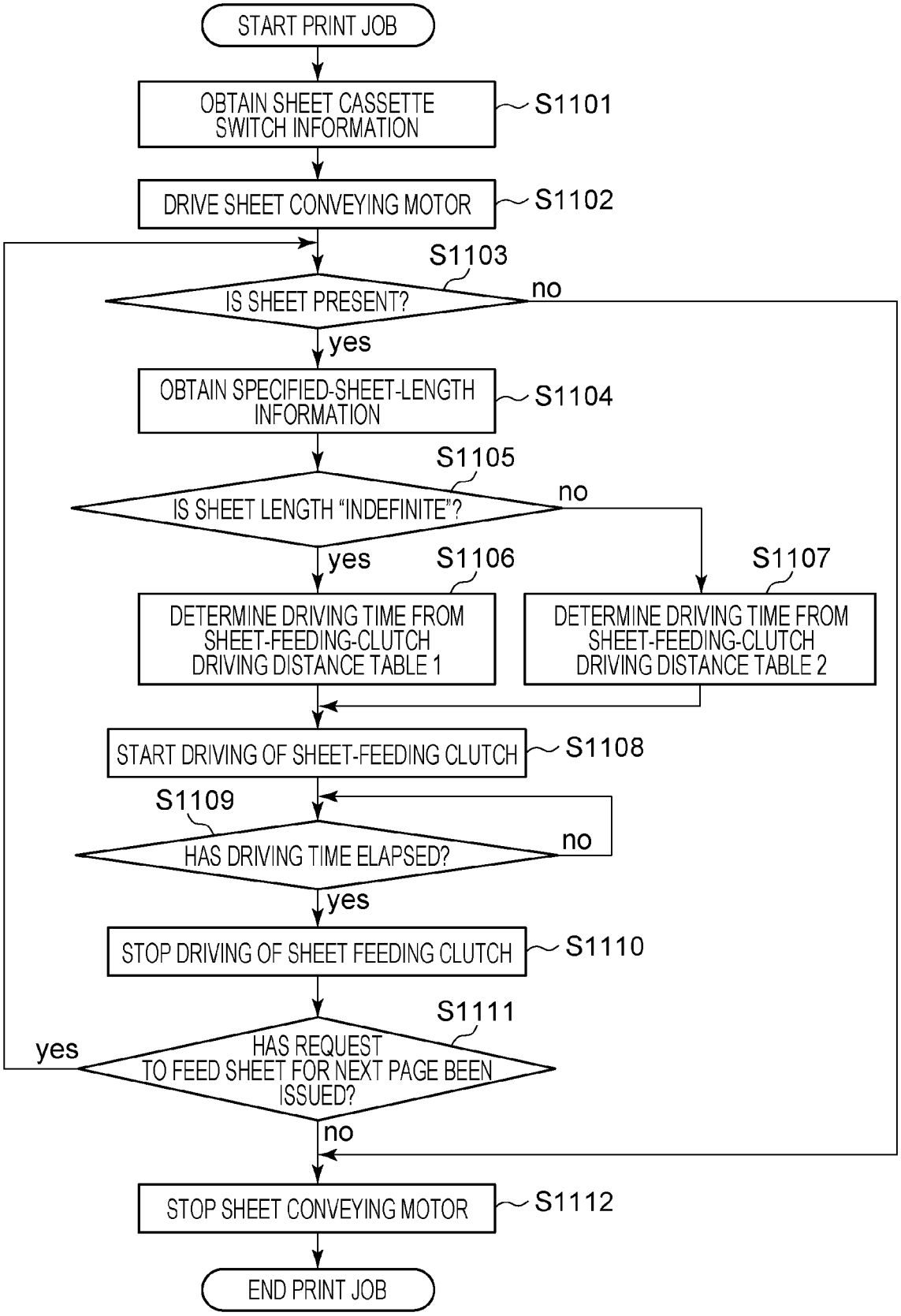
FIG. 11 is a flowchart for sheet conveyance control according to the first embodiment.

Sheet conveyance control using the sheet feeding clutch 216 in the present disclosure will be described with reference to the flowchart in FIG. 11. This flowchart is stored in the ROM 206 and is executed by the CPU 205.

When a print job is started, in step 1101 (hereinafter referred to as S1101), the CPU 205 obtains output values from the switches 70 and 71 of the regulating-plate detecting mechanism 57 as the positional information on the trailing-end regulating plate 42 of the sheet feed cassette 1. Next in S1102, the CPU 205 drives the sheet conveying motor 215 and proceeds to S1103. In S1103, the CPU 205 detects whether sheets P are contained in the sheet feed cassette 1 using the sheet detection sensor 59. If sheets P are not contained, the process proceeds to S1112, and the CPU 205 stops the sheet conveying motor 215 to terminate the print job. If sheet P are contained, the process proceeds to S1104, and the CPU 205 obtains sheet length information, which is specified by the user on the page setting screen in FIG. 10B and stored in the RAM 207. Next, in S1105, the CPU 205 determines whether the obtained sheet length information is an "indefinite" code.

If in S1105 the sheet length information is "indefinite", then in S1106 the CPU 205 determines the time during which the sheet feeding clutch 216 is to be driven. To determine the driving time, the CPU 205 uses a sheet-feeding-clutch driving distance table 1 illustrated in FIG. 12A. This table is stored in the ROM 206. The operating time of the sheet feeding clutch 216 corresponds to the time during which the feeding operation of the pickup roller 32 and the sheet feeding roller 33 is executed.

In the case of switch 70: OFF and switch 71: ON, the CPU 205 determines the conveying time for the distance of 148.0 mm corresponding to the minimum size in the range 1101 illustrated in FIG. 9B as the sheet-feeding-clutch driving time. In the case of switch 70: OFF and switch 71: OFF, the CPU 205 determines the conveying time for the distance of 278.0 mm corresponding to the minimum size in the range 1102 in FIG. 9B as the sheet-feeding-clutch driving time. In the case of switch 70: ON and switch 71: OFF, the CPU 205 determines the conveying time for the distance of 290.0 mm corresponding to the minimum size in the range 1103 in FIG. 9B as the sheet-feeding-clutch driving time. In the case of switch 70: ON and switch 71: ON, the CPU 205 determines the conveying time for the distance of 306.0 mm corresponding to the minimum size in the range 1104 in FIG. 9B as the sheet-feeding-clutch driving time.

If in S1105 the sheet length information is not "indefinite", then in S1107 the CPU 205 determines the time during which the sheet feeding clutch 216 is to be driven. To determine the driving time, the CPU 205 uses a sheet-feeding-clutch driving distance table 2 illustrated in FIG. 12B. This table is stored in the ROM 206.

In the case of switch 70: OFF and switch 71: ON, if the specified sheet length is within the range from 148.0 mm to 277.9 mm, the CPU 205 determines the conveying time for the specified sheet length as the sheet-feeding-clutch driving time. If the specified sheet length is 278.0 mm or more, the CPU 205 determines that the user specified an incorrect sheet length. This is because the specified sheet length exceeds the position of the trailing-end regulating plate 42, so that the sheet P cannot be physically accommodated in the sheet feed cassette 1. The CPU 205 determines the conveying time for the distance of 148.0 mm corresponding to the minimum size in the range 1101 in FIG. 9B as the sheet-feeding-clutch driving time.

In the case of switch 70: OFF and switch 71: OFF, if the specified sheet length is within the range from 148.0 mm to 289.9 mm, the CPU 205 determines the conveying time for the specified sheet length as the sheet-feeding-clutch driving time. If the specified sheet length is 290.0 mm or more, the CPU 205 determines that the user specified an incorrect sheet length. This is because the specified sheet length exceeds the position of the trailing-end regulating plate 42, so that the sheets P cannot be physically accommodated in the sheet feed cassette 1. The CPU 205 determines the conveying time for the distance of 278.0 mm corresponding to the minimum size in the range 1102 in FIG. 9B as the sheet-feeding-clutch driving time.

In the case of switch 70: ON and switch 71: OFF, if the specified sheet length is within the range from 148.0 mm to 305.9 mm, the CPU 205 determines the conveying time for the specified sheet length as the sheet-feeding-clutch driving time. If the specified sheet length is 306.0 mm or more, the CPU 205 determines that the user specified an incorrect sheet length. This is because the specified sheet length exceeds the position of the trailing-end regulating plate 42, so that the sheets P cannot be physically accommodated in the sheet feed cassette 1. The CPU 205 determines the conveying time for the distance of 290.0 mm corresponding to the minimum size in the range 1103 in FIG. 9B as the sheet-feeding-clutch driving time.

In the case of switch 70: ON and switch 71: ON, the CPU 205 determines the conveying time for the specified sheet length as the sheet-feeding-clutch driving time.

Since the values listed in the tables in FIGS. 12A and 12B are distances, the time during which the sheet feeding clutch 216 is actually driven changes according to the sheet P feeding speed of the pickup roller 32 and the sheet feeding roller 33. Therefore, the CPU 205 sets the sheet-feeding-clutch driving time according to the feeding speed of the sheets P.

Next, in S1108, the CPU 205 starts to drive the sheet feeding clutch 216, and in S1109, the CPU 205 waits for the time determined in S1106 or S1107 to elapse. After the time elapses, the process proceeds to S1110, in which the CPU 205 stops the driving of the sheet feeding clutch 216. In S1111, the CPU 205 determines whether a request to feed a sheet P for the next page has been issued. If the request has been issued, the process proceeds to S1103, and the sheet feeding operation is repeated. If the request has not been issued, the process proceeds to S1112, in which the sheet conveying motor 215 is stopped to terminate the print job.

A method for setting the size range (minimum size and maximum size) of the sheet P listed in FIG. 9B and beneficial effects obtained by executing the flowchart illustrated in FIG. 11 will be described.

Figures 9A, 9B:
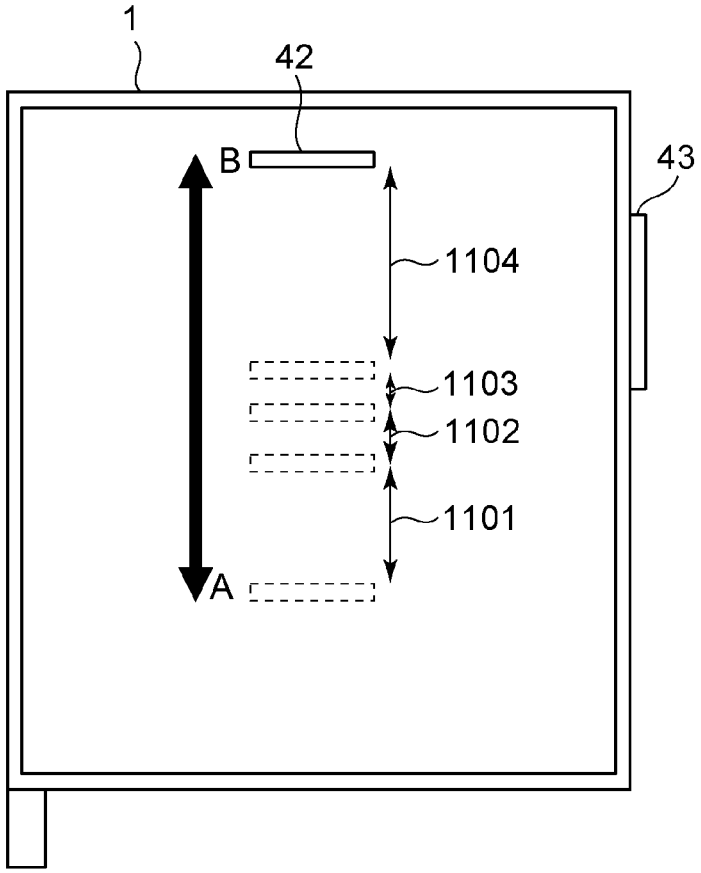
FIG. 9A is a diagram of the sheet feed cassette illustrating the position of a trailing-end regulating plate.
FIG. 9B is a diagram illustrating the relationship between values detected by the regulating-plate detecting mechanism and the position of the trailing-end regulating plate.

First, the maximum size corresponding to the position of the trailing-end regulating plate 42 in FIG. 9B indicates the maximum size of the sheets P that can be physically accommodated in the sheet feed cassette 1 without a trailing-end of the sheets P extending or being positioned over the position of the trailing-end regulating plate 42. The minimum size corresponding to the position of the trailing-end regulating plate 42 in FIG. 9B does not indicate the minimum size of the sheets P that can be physically accommodated in the sheet feed cassette 1 without a trailing-end of the sheets P extending or being positioned over the position of the trailing-end regulating plate 42.

The minimum size in the range 1101 corresponds to the length of smallest sheets P that can be printed by the printer 100. This is set based on the longest distance among the distances between the rollers, as described above. The minimum size in the range 1102 is set based on the following idea. When the trailing-end regulating plate 42 is in the range 1102, the sheets P of the lengths from 278.0 mm to 289.9 mm can be newly accommodated in addition to the that in the case of range 1101. If the sheets P of the length in this range are fed, for example, for the sheet-feeding-clutch driving time for the distance of 148.0 mm, the sheets P can stagnate halfway because of insufficient assisting force, causing a sheet jam. For that reason, the minimum size in the range 1102 is set to 278.0 mm to sufficiently assist the sheets P in the range of 278.0 mm to 289.9 mm in length. The range 1103 and subsequent ranges are also set based on the same idea.

Thus, in the present embodiment, when the specified sheet length is "indefinite", the sheet-feeding-clutch driving distance table 1 illustrated in FIG. 12A is selected to determine the sheet-feeding-clutch driving time. In FIG. 12A, the minimum size corresponding to the position of the trailing-end regulating plate 42 is adopted as the sheet-feeding-clutch driving time. This prevents a next sheet P that is not to be fed from being incorrectly picked up and fed by the pickup roller 32 and the sheet feeding roller 33. Another benefit is that jamming of the sheet P can be reduced by increasing the conveyance assisting force of the pickup roller 32 and the sheet feeding roller 33.

If the specified sheet length is not "indefinite", in the present embodiment, the sheet-feeding-clutch driving distance table 2 illustrated in FIG. 12B is selected to determine the sheet-feeding-clutch driving time. In FIG. 12B, when the sheet size specified by the user is larger than the maximum size corresponding to the position of the trailing-end regulating plate 42, the minimum size corresponding to the position of the trailing-end regulating plate 42 is adopted as the sheet-feeding-clutch driving time. This prevents a next sheet P that is not to be fed from being incorrectly picked up and fed by the pickup roller 32 and the sheet feeding roller 33. Another benefit is that jamming of the sheet P can be reduced by increasing the conveyance assisting force of the pickup roller 32 and the sheet feeding roller 33.

The present embodiment provides a feeding apparatus in which a sheet jam due to a difference between a specified sheet size and the size of sheets placed on a placement unit is reduced to increase the usability.

In the present embodiment, the sheet-feeding-clutch driving time illustrated in FIG. 12A is for the minimum size corresponding to the position of the trailing-end regulating plate 42. This is provided merely for illustrative purposes. This may be for a predetermined size in a size range corresponding to the position of the trailing-end regulating plate 42. For example, in the case of the range 1101, the sheet-feeding-clutch driving time may not be for the distance of 148.0 mm, which is the minimum size, but may be for the distance of 200 mm, because it is only required that the conveyance can be assisted so that jamming does not occur. This applies also to the sheet-feeding-clutch driving time illustrated in FIG. 12B which is used when the sheet size specified by the user is larger than the maximum size corresponding to the position of the trailing-end regulating plate 42.

Second Embodiment

In a second embodiment, it is determined whether to place importance on the conveyance assisting force of the pickup roller 32 and the sheet feeding roller 33 based on the environment information around the printer 100 and information on the type of the sheets P, and a table for determining the sheet-feeding-clutch driving time is selected. Descriptions of principal parts are the same as those in the first embodiment, and differences from the first embodiment will be described herein.

Outline of Image Forming Apparatus

Figure 13:
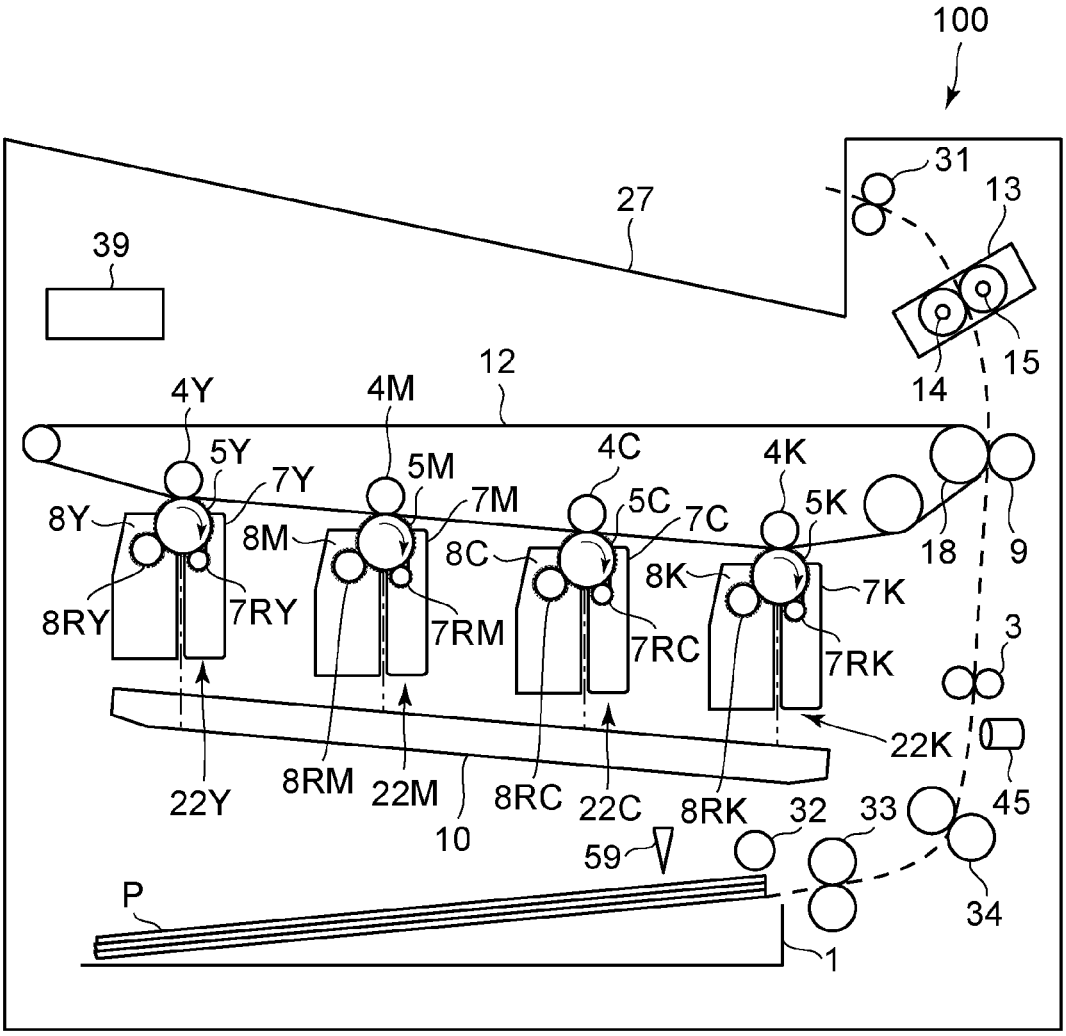
FIG. 13 is a schematic diagram of an image forming apparatus according to a second embodiment of the present disclosure.

The outline of an image forming apparatus according to the present embodiment will be described with reference to FIG. 13. The same components as those in the first embodiment are denoted by the same reference signs and descriptions thereof will be omitted.

A difference from the printer 100 of the first embodiment is that an environment sensor 39 and a media sensor 45 are newly provided. The environment sensor 39 is a sensor for detecting environment information on the place where the printer 100 is installed, such as the temperature and humidity. The media sensor 45 is a sensor for detecting information on the type of the sheets P and is disposed on the conveying path of the sheets P. Examples of the type of the sheets P include the thickness and the basis weight of the sheet P. The thickness of the sheet P can be determined using a sensor configuration in which the surface of the sheet P is irradiated with light, and the light that has passed through the sheet P is received. The basis weight of the sheet P can be determined using a sensor configuration in which the surface of the sheet P is irradiated with ultrasonic waves and the ultrasonic waves that are attenuated via the sheet P is received.

System Configuration of Image Forming Apparatus

Figure 14:
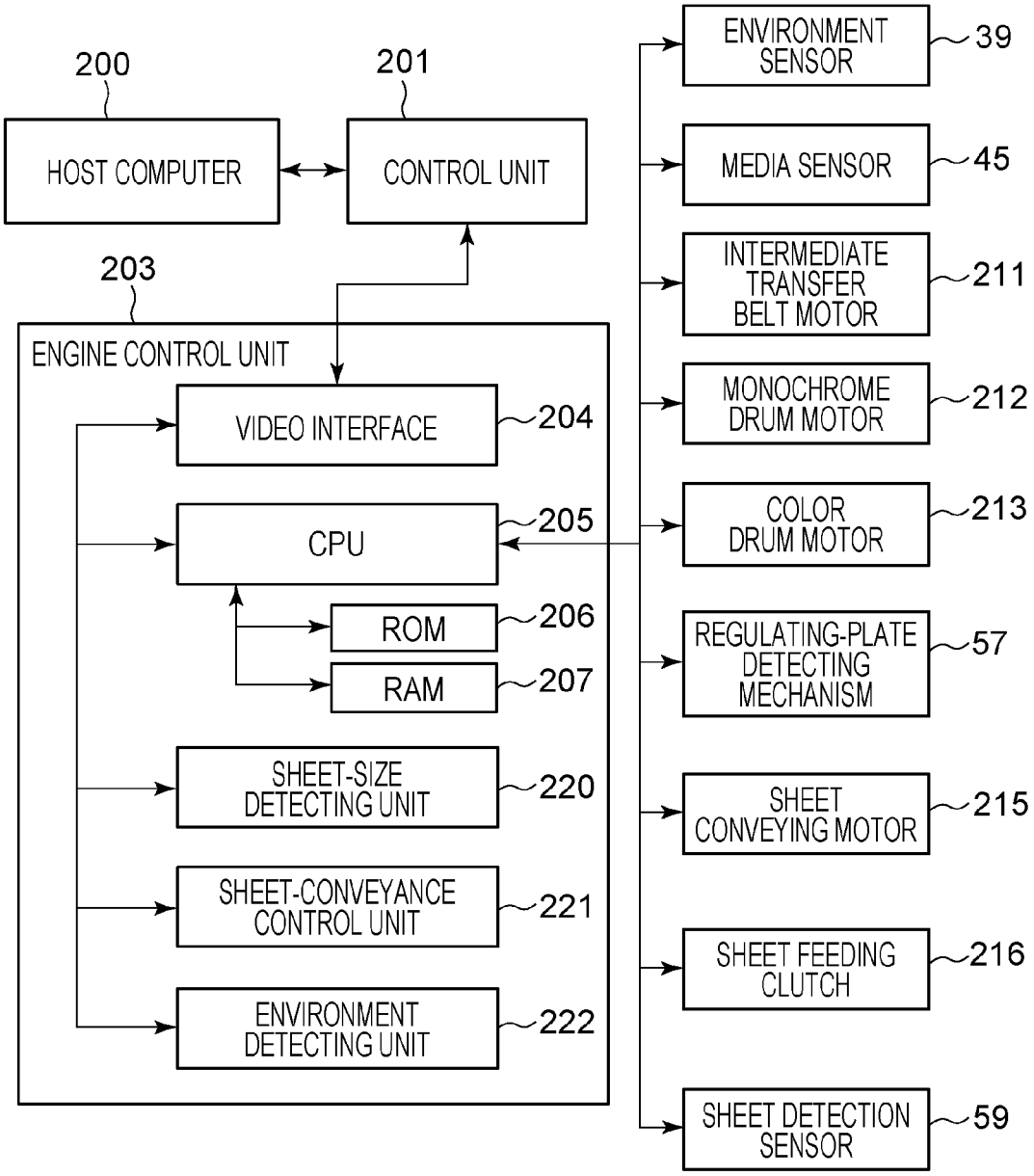
FIG. 14 is a block diagram illustrating the system configuration of the image forming apparatus according to the second embodiment.

Next, the general system configuration of the control unit of the printer 100 will be described with reference to a block diagram in FIG. 14. The same components as those in the first embodiment are denoted by the same reference signs and descriptions thereof will be omitted.

The environment sensor 39 detects temperature data and humidity data, which is environment information, and outputs the data to the CPU 205. An environment detecting unit 222 determines ambient environment during printing from the output from the environment sensor 39. The CPU 205 corrects various voltages (a transfer bias and so on) for image formation based on the detection result from the environment sensor 39. The media sensor 45 detects information on the type of the sheets P, that is, data on the amount of light transmitted and data on the amplitude of attenuated ultrasonic waves, and outputs the data to the CPU 205. The CPU 205 determines the type of the sheets P from the detection result from the media sensor 45 and changes image forming conditions, such as a transfer bias and a fixing temperature, according to the determined type.

Configuration of Environment Sensor

Figure 15:
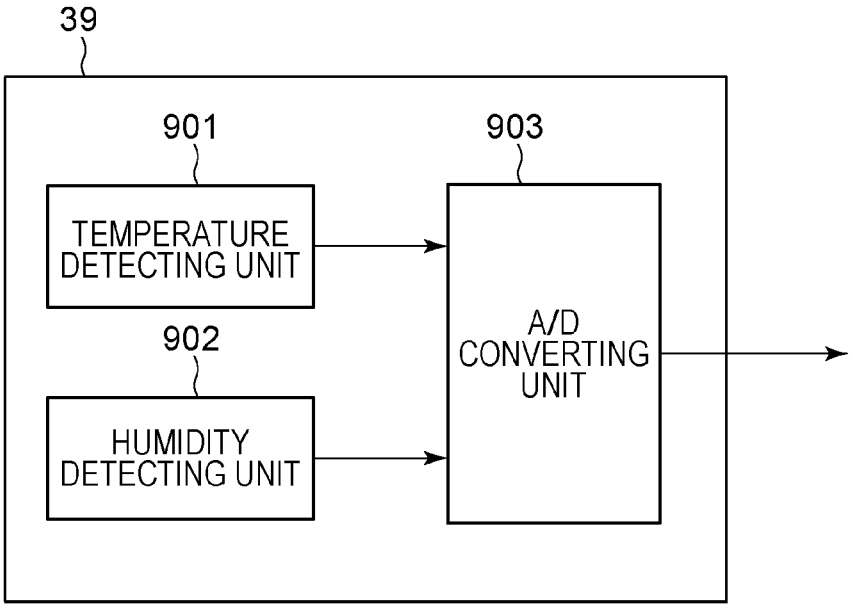
FIG. 15 is a block diagram illustrating the configuration of an environment sensor according to the second embodiment.

The configuration of the environment sensor 39 will be described with reference to FIG. 15. A temperature detecting unit 901 detects the temperature in the vicinity of the environment sensor 39 and inputs the detection signal to an analog-to-digital (A/D) converting unit 903. A humidity detecting unit 902 detects the humidity in the vicinity of the environment sensor 39 and inputs the detected signal to the A/D converting unit 903. The A/D converting unit 903 converts the input analog signal to a digital signal and outputs the digital signal. The digital signal is read by the CPU 205. The CPU 205 selectively reads the temperature data and the humidity data at predetermined intervals and stores the read data in the RAM 207.

The environment detecting unit 222 calculates the amount of moisture content in the air from a saturated water vapor content based on the temperature data stored in the RAM 207 and relative humidity obtained from the humidity data using the following expression.

$$\text{Moisture content in the air } [g/m^3] = \text{Saturated water vapor content } [g/m^3] \times \text{Relative humidity } [\%]$$

The calculated moisture content in the air is stored in the RAM 207 and is used for sheet feeding control, described later.

Specifying Size of Recording Material for Printing

Figure 16:
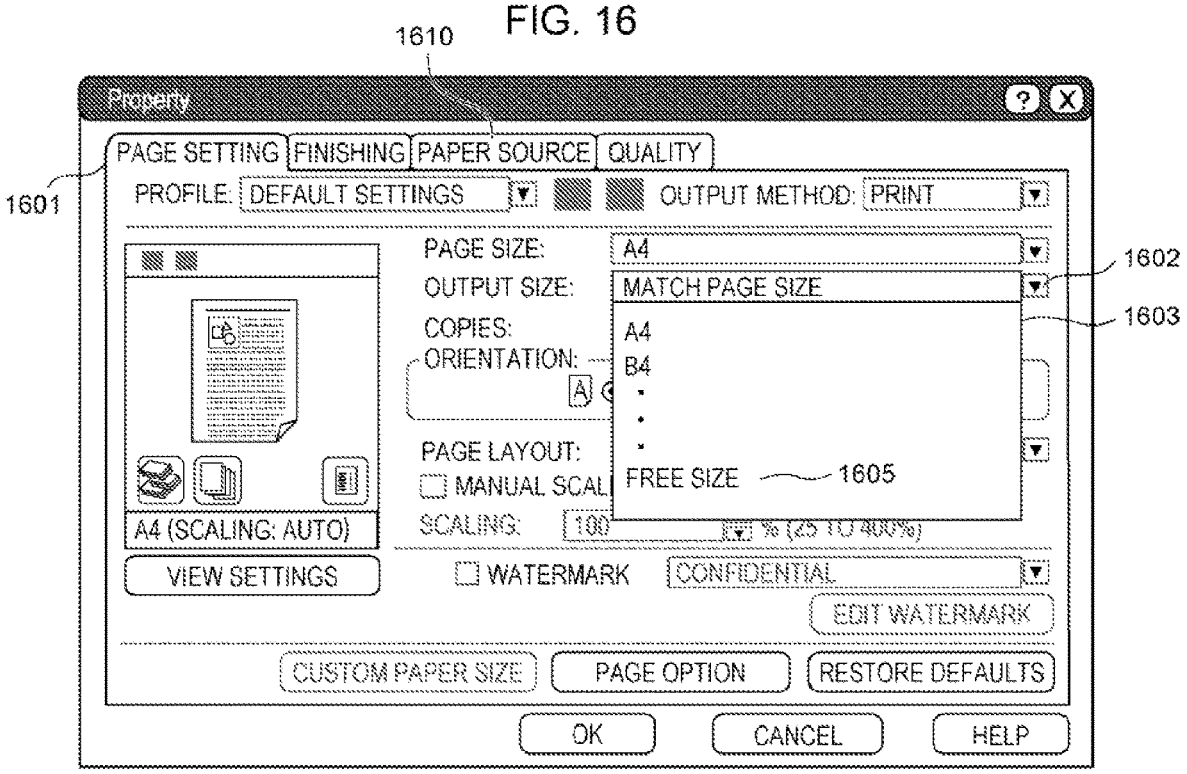
FIG. 16 is a diagram illustrating a property setting screen of a printer driver according to the second embodiment.

Specification of the size of the sheets P will be described with reference to FIG. 16. FIG. 16 is a property setting screen of a printer driver, in which document size, output sheet size, the number of copies, and so on can be set on a page setting screen 1601. When a pull-down 1602 for output sheet size is selected, a size option menu 1603 is displayed. In the size option menu 1603, Free size 1605 is displayed as well as A4, B4, etc., which are standard sizes. Free size 1605 is a setting for the user to use sheets P cut in a predetermined size. When the user selects Free size 1605, a size setting screen 1006 in FIG. 10C is displayed. The user respectively inputs the width and height of the sheets P to be used into a width entry field 1007 and a height entry field 1008.

The thus-specified sheet size is notified as a printing instruction to the control unit 201. The control unit 201 notifies the engine control unit 203 of the sheet width information set by the driver as width information on the sheets P to be fed in the printer and the sheet height information as length information on the sheets P. In the case where Free size 1605 is specified, the width entered in the width entry field 1007 as width information and the height entered as length information in the height entry field 1008 are transmitted. In the case where a standard size is selected, a width and a length corresponding to the standard size are transmitted. The CPU 205 stores the width information and the length information received via the video interface 204 in the RAM 207.

A page source screen 1610 in FIG. 16 is used for the user to set the type of the sheets P, such as thin paper, plain paper, or cardboard. The set information on the type of the sheets P is transmitted to the engine control unit 203 via the control unit 201 at the start of printing. The CPU 205 stores the information on the type of the sheets P in the RAM 207 via the video interface 204. Thus, the information on the type of the sheets P is obtained by the user setting it on the printer driver, not only by the media sensor 45 sensing the sheet P.

Sheet Feeding Operation of Second Embodiment

Figure 17:
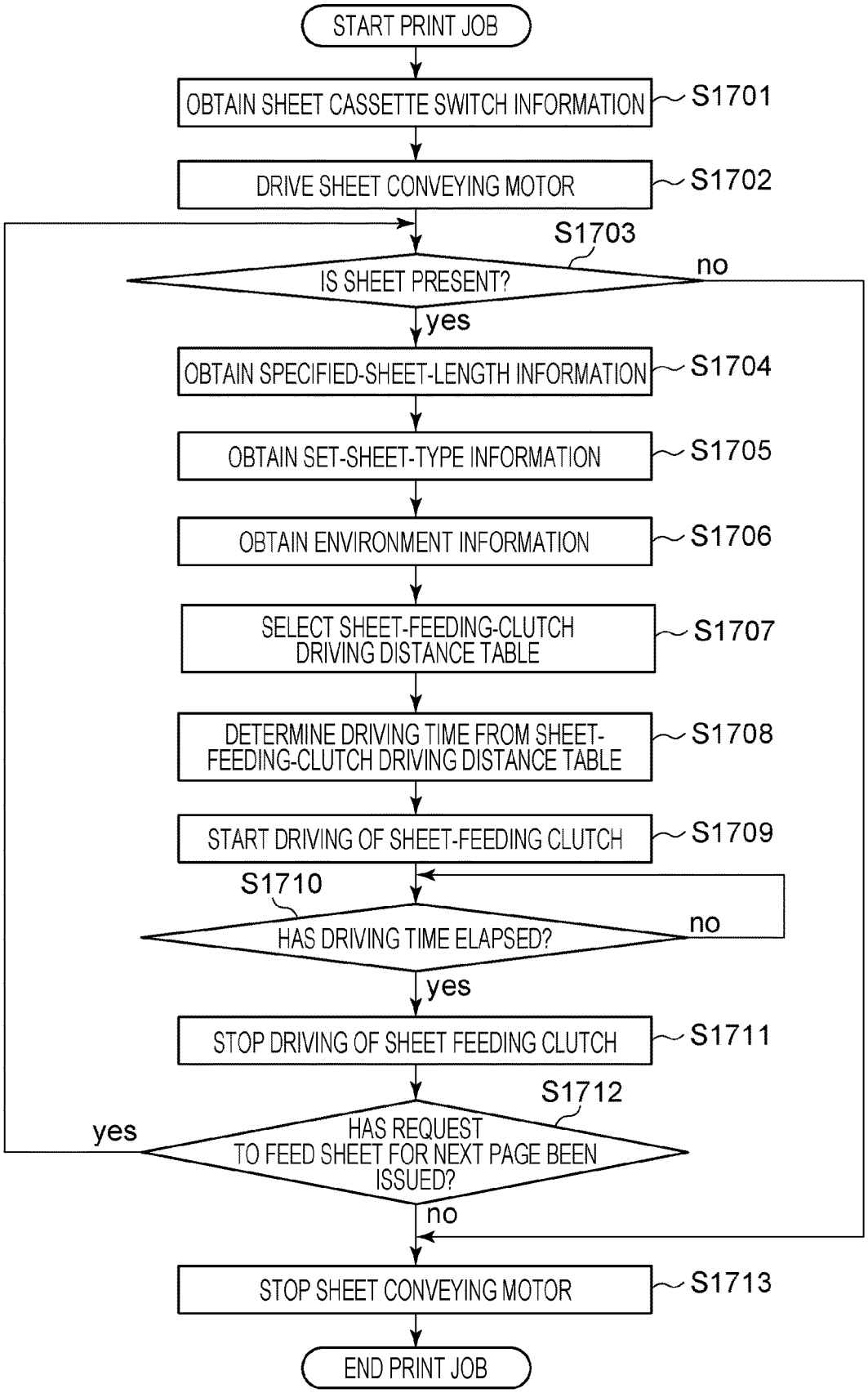
FIG. 17 is a flowchart for sheet conveyance control according to the second embodiment.

Sheet conveyance control using the sheet feeding clutch 216 in the present disclosure will be described with reference to the flowchart in FIG. 17. This flowchart is stored in the ROM 206 and is executed by the CPU 205.

In the second embodiment, it is determined whether assist of the conveyance using the pickup roller 32 and the sheet feeding roller 33 is necessary from the environment information and the information on the type of the sheets P, and the driving time of the sheet feeding clutch is determined. In the present embodiment, in the case where the sheets P have a large basis weight or thickness or in an environment where the moisture content in the air is low, it is determined that assist of the conveyance is necessary because the sheets P possess high stiffness.

When a print job is started, in step 1701 (hereinafter referred to as S1701), the CPU 205 obtains output values from the switches 70 and 71 of the regulating-plate detecting mechanism 57 as the positional information on the trailing-end regulating plate 42 of the sheet feed cassette 1. Next in S1702, the CPU 205 drives the sheet conveying motor 215 and proceeds to S1703. In S1703, the CPU 205 detects whether sheets P are contained in the sheet feed cassette 1 using the sheet detection sensor 59. If sheets P are not contained, the process proceeds to S1713, and the CPU 205 stops the sheet conveying motor 215 to terminate the print job. If sheets P are contained, the process proceeds to S1704, and the CPU 205 obtains sheet length information, which is specified by the user on the page setting screen 1601 in FIG. 16 and stored in the RAM 207. Next, in S1705, the CPU 205 obtains the information on the type of the sheets P, which is set by the user on the page source screen 1610 in FIG. 16 or detected by the media sensor 45, from the RAM 207, and the process proceeds to S1706. In S1706, the CPU 205 obtains the moisture content in the air, which is obtained from the output value from the environment sensor 39, from the RAM 207, and the process proceeds to S1707. In S1707, the CPU 205 selects a sheet-feeding-clutch driving distance table for determining the driving time of the sheet feeding clutch 216.

FIG. 18 is a table for selecting a sheet-feeding-clutch driving distance table. The table is stored in the ROM 206. In the case where the type of the sheets P is thin paper, the CPU 205 selects the sheet-feeding-clutch driving distance table 1 illustrated in FIG. 12A regardless of the moisture content in the air. In the case where the type of the sheets P is plain paper, the CPU 205 selects the sheet-feeding-clutch driving distance table 2 illustrated in FIG. 12B when the moisture content in the air is in the range from 0 to 5.8 g/m$^3$, and selects the sheet-feeding-clutch driving distance table 1 illustrated in FIG. 12A when the moisture content is 5.9 g/m$^3$ or more. In the case where the type of the sheets P is cardboard, the CPU 205 selects the sheet-feeding-clutch driving distance table 2 illustrated in FIG. 12B regardless of the moisture content in the air.

Next, in S1708, the CPU 205 determines the sheet-feeding-clutch driving time from the selected sheet-feeding-clutch driving distance table, the output values from the switch 70 and the switch 71, and the specified sheet length information. Next, in S1709, the CPU 205 starts to drive the sheet feeding clutch 216, and in S1710, the CPU 205 waits for the time determined in S1708 to elapse. After the time elapses, the process proceeds to S1711, in which the CPU 205 stops the driving of the sheet feeding clutch 216. In S1712, the CPU 205 determines whether a request to feed a sheet P for the next page has been issued. If the request has been issued, the process proceeds to S1703, and the sheet feeding operation is repeated. If the request has not been issued, the process proceeds to S1713, in which the sheet conveying motor 215 is stopped to terminate the print job.

The reason why the tables are selected as in FIG. 18 will be described below. When the sheets P have a relatively small basis weight or thickness, the sheets P have low stiffness, so that the CPU 205 determines that assist of conveyance is not necessary. Therefore, the CPU 205 selects the sheet-feeding-clutch driving distance table 1 illustrated in FIG. 12A with emphasis on preventing a next sheet P that is not to be fed from being incorrectly picked up and fed by the pickup roller 32 and the sheet feeding roller 33. In contrast, in the case where the sheets P have a relatively large basis weight or thickness, the sheets P have high stiffness, so that the CPU 205 determines that assist of conveyance is necessary. Therefore, the CPU 205 selects the sheet-feeding-clutch driving distance table 2 illustrated in FIG. 12B with emphasis on increasing the conveyance assisting force of the pickup roller 32 and the sheet feeding roller 33.

When the moisture content in the air is large, it is conceivable that the sheets P contained in the sheet feed cassette 1 may have a high moisture content. Since the moist sheets P have low stiffness, the CPU 205 determines that assist of conveyance is not necessary. Therefore, the CPU 205 selects the sheet-feeding-clutch driving distance table 1 illustrated in FIG. 12A with emphasis on preventing the next sheet P that is not to be fed from being erroneously picked up and fed by the pickup roller 32 and the sheet feeding roller 33. In contrast, when the moisture content in the air is small, it is conceivable that the sheets P contained in the sheet feed cassette 1 have not so much moisture content. Since the sheets P having no moisture content, for example, paper just after being unpacked, have high stiffness, the CPU 205 determines that assist of conveyance is necessary. Therefore, the CPU 205 selects the sheet-feeding-clutch driving distance table 2 illustrated in FIG. 12B with emphasis on increasing the conveyance assisting force of the pickup roller 32 and the sheet feeding roller 33.

Thus, the present embodiment has the following beneficial effects in addition to the beneficial effects of the first embodiment. In other words, the present embodiment reduces jamming of the sheets P while keeping the sheets P conveying force by using environment information and information on the type of the sheets P.

In the first and second embodiments, the time during which the feeding operation of the pickup roller 32 and the sheet feeding roller 33 is executed is changed by changing the driving time of the sheet feeding clutch 216. The present disclosure is not limited to the above. The driving time of the sheet conveying motor 215 may be changed. In other words, the CPU 205 stops the driving of the sheet conveying motor 215 at a timing at which the time obtained from the table illustrated in FIG. 12A, 12B, or 18 has elapsed. In this case, the drawing roller pair 34 and the registration roller pair 3 may be driven by a motor different from the sheet conveying motor 215.

In the first and second embodiments, the information on the type of the sheets P may be obtained by the user inputting it on an operation panel (not illustrated) provided on the printer 100.

While the first and second embodiments illustrate the image forming apparatus by way of example, a feeding apparatus to which the present disclosure is applied is not limited to the above. The present disclosure may also be applied to an optional sheet feeding apparatus that is detachably mounted to an image forming apparatus.

While first and second embodiments illustrate the laser beam printer by way of example, the image forming apparatus to which the present disclosure is not limited to the above. The present disclosure may also be applied to printers or copiers of other printing systems, such as an inkjet printer.

While the present invention has been described with reference to embodiments, it is to be understood that the invention is not limited to the disclosed embodiments. The scope of the following claims is to be accorded the broadest interpretation to encompass all such modifications and equivalent structures and functions.

This application claims the benefit of Japanese Patent Application No. 2017-128952 filed Jun. 30, 2017, which is hereby incorporated by reference herein in its entirety.

What is claimed is:

1. A feeding apparatus comprising:

a placement unit on which a recording material is to be placed;

a feeding rotating member configured to feed the recording material placed on the placement unit;

a regulating plate configured to regulate a position of an upstream end of the recording material placed on the placement unit in a feeding direction by the feeding rotating member;

a detecting unit configured to detect a size of the recording material from a position of the regulating plate;

a receiving unit configured to receive a size of the recording material specified by a user; and a control unit configured to change duration of a feeding operation performed by the feeding rotating member, and wherein, in a case where the received size of the recording material is smaller than the detected size of the recording material, the control unit changes the feeding operation duration according to the received size of the recording material.

2. The feeding apparatus according to claim 1, wherein the regulating plate is movable to a plurality of positions, and wherein the detecting unit detects a size range of the recording material that can be placed on the placement unit without the recording material being positioned over the regulating plate according to each of the plurality of positions of the regulating plate.

3. The feeding apparatus according to claim 2, wherein, in a case where the received size of the recording material is smaller than a maximum size in the recording material size range detected by the detecting unit, the control unit changes the feeding operation duration according to the received size of the recording material.

4. The feeding apparatus according to claim 2, wherein, in a case where the received size of the recording material is larger than a maximum size in the recording material size range detected by the detecting unit, the control unit changes the feeding operation duration according to a predetermined size in the recording material size range.

5. The feeding apparatus according to claim 4, further comprising a sensor configured to detect environment information, wherein the control unit switches between first control and second control based on the environment information detected by the sensor, wherein the first control is configured to change the feeding operation duration according to the predetermined size in the recording material size range regardless of the received size of the recording material, and wherein the second control is configured to change the feeding operation duration according to the received size of the recording material.

6. The feeding apparatus according to claim 5, wherein the control unit is configured to obtain, from the environment information, a moisture content in air around the feeding apparatus, wherein, in a case where the moisture content is a first moisture content, the control unit executes the first control, and wherein, in a case where the moisture content is a second moisture content less than the first moisture content, the control unit executes the second control.

7. The feeding apparatus according to claim 4, further comprising an obtaining unit configured to obtain information on a type of the recording material, wherein the control unit is configured to switch between first control and second control based on the information on the recording material type, wherein the first control is configured to change the feeding operation duration according to the predetermined size in the recording material size range regardless of the received size of the recording material, and wherein the second control is configured to change the feeding operation duration according to the received size of the recording material.

8. The feeding apparatus according to claim 7, wherein, in a case where the recording material is a first type, the control unit executes the first control, and wherein, in a case where the recording material is a second type which is larger in thickness or basis weight than the first type, the control unit executes the second control.

9. The feeding apparatus according to claim 4, wherein the predetermined size is a minimum size in the recording material size range.

10. The feeding apparatus according to claim 9, wherein the regulating plate is movable to a plurality of positions on the placement unit, and wherein, in a case where, among the plurality of positions on the placement unit, the regulating plate is at a position at which a recording material of a smallest size can be placed, the maximum size in the recording material size range is a maximum size of the recording material that can be placed on the placement unit without the recording material being positioned over the regulating plate position, and the minimum size in the recording material size range is longer than a longest distance of distances between a plurality of adjacent conveying units that convey the recording material.

11. The feeding apparatus according to claim 9, wherein the regulating plate can move between a first position and a second position at which a size of the recording material that can be placed on the placement unit is larger than a size of the recording material that can be placed on the placement unit at the first position, wherein a maximum size in a size range of the recording material corresponding to a state in which the regulating plate is at the second position is a maximum size of the recording material that can be placed on the placement unit without the recording material being positioned over the regulating plate position, and wherein a minimum size in the recording material size range corresponding to the state in which the regulating plate is at the second position is larger than a maximum size in the recording material size range corresponding to a state in which the regulating plate is at the first position.

12. The feeding apparatus according to claim 1, further comprising:

a motor configured to rotate the feeding rotating member; and a clutch configured to transmit or interrupt a driving force of the motor to or from the feeding rotating member, wherein the control unit is configured to change duration of a time during which the driving force from the motor is transmitted to the feeding rotating member by the clutch.

13. A feeding apparatus comprising:

a placement unit on which a recording material is to be placed;

a feeding rotating member configured to feed the recording material placed on the placement unit;

a regulating plate configured to regulate a position of an upstream end of the recording material placed on the placement unit in a feeding direction by the feeding rotating member;

a detecting unit configured to detect a size of the recording material from a position of the regulating plate;

a receiving unit configured to receive a size of the recording material specified by a user; and a control unit configured to change duration of a feeding operation performed by the feeding rotating member, and wherein, in a case where the received size of the recording material is larger than the detected size of the recording material, the control unit changes the feeding operation duration according to the detected size of the recording material.

14. The feeding apparatus according to claim 13, wherein the regulating plate is movable to a plurality of positions, and wherein the detecting unit detects a recording material that can be placed on the placement unit without the recording material being positioned over the regulating plate according to each of the plurality of positions of the regulating plate.

15. The feeding apparatus according to claim 14, wherein, in a case where the received size of the recording material is larger than a maximum size in the recording material size range detected by the detecting unit, the control unit changes the feeding operation duration according to a predetermined size in the recording material size range.

16. The feeding apparatus according to claim 15, wherein the predetermined size is a minimum size in the recording material size range.

17. The feeding apparatus according to claim 13, further comprising:

a motor configured to rotate the feeding rotating member; and a clutch configured to transmit or interrupt a driving force of the motor to or from the feeding rotating member, wherein the control unit is configured to change duration of a time during which the driving force from the motor is transmitted to the feeding rotating member by the clutch.

18. A feeding apparatus comprising:

a placement unit on which a recording material is to be placed;

a feeding rotating member configured to feed the recording material placed on the placement unit;

a regulating plate configured to regulate a position of an upstream end of the recording material placed on the placement unit in a feeding direction by the feeding rotating member;

a detecting unit configured to detect a position of the regulating plate;

a receiving unit configured to receive a size of the recording material specified by a user; and a control unit configured to, in a case where the received size of the recording material is indefinite, set duration of a feeding operation performed by the feeding rotating member to a first duration when the detecting unit detects that the regulating plate is at a first position and set the feeding operation duration to a second duration longer than the first duration when the detecting unit detects that the regulating plate is at a second position which is farther from the feeding rotating member than the first position.

19. The feeding apparatus according to claim 18, wherein the detecting unit further is configured to detect a size range of the recording material that can be placed on the placement unit without the recording material being positioned over the regulating plate according to each of a plurality of positions of the regulating plate.

20. The feeding apparatus according to claim 19, wherein, in the case where the received size of the recording material is indefinite, the control unit changes the feeding operation duration according to a predetermined size in the recording material size range detected by the detecting unit.

21. The feeding apparatus according to claim 20, wherein the predetermined size is a minimum size in the recording material size range.

22. The feeding apparatus according to claim 19, wherein, in a case where the received size of the recording material is smaller than a maximum size in the recording material size range detected by the detecting unit, the control unit changes the feeding operation duration according to the received size of the recording material.

23. The feeding apparatus according to claim 19, wherein, in a case where the received size of the recording material is larger than a maximum size in the recording material size range detected by the detecting unit, the control unit changes the feeding operation duration according to a predetermined size in the recording material size range.

24. The feeding apparatus according to claim 18, further comprising:

a motor configured to rotate the feeding rotating member; and a clutch configured to transmit or interrupt a driving force of the motor to or from the feeding rotating member, wherein the control unit is configured to change duration of a time during which the driving force from the motor is transmitted to the feeding rotating member by the clutch.

25. The feeding apparatus according to claim 18, wherein the case where the received size of the recording material is indefinite is a case where the user selects a universal mode.

* * * * *